US007216817B2

(12) United States Patent
Turk et al.

(10) Patent No.: US 7,216,817 B2
(45) Date of Patent: May 15, 2007

(54) IMPACT SPRINKLER DRIVE SYSTEM

(75) Inventors: Michael F. Turk, Los Angeles, CA (US); Richard J. Russell, II, Tujunga, CA (US)

(73) Assignee: Rain Bird Corporation, Azusa, CA (US)

( * ) Notice: Subject to any disclaimer, the term of this patent is extended or adjusted under 35 U.S.C. 154(b) by 0 days.

(21) Appl. No.: 11/182,434

(22) Filed: Jul. 15, 2005

(65) Prior Publication Data

US 2006/0011743 A1 Jan. 19, 2006

Related U.S. Application Data

(60) Provisional application No. 60/588,532, filed on Jul. 16, 2004.

(51) Int. Cl.

| | |
|---|---|
| ***B05B 3/14*** | (2006.01) |
| ***B05B 3/08*** | (2006.01) |
| ***B05B 3/00*** | (2006.01) |
| ***B05B 3/04*** | (2006.01) |
| ***B05B 3/16*** | (2006.01) |

(52) U.S. Cl. ..... 239/230; 239/231; 239/233; 239/DIG. 1

(58) Field of Classification Search ..... 239/230, 239/231, 233, DIG. 1, 200, 214.13, 222.11, 239/222.13, 222.15, 222.17, 222.19, 225.1, 239/232, 255, 273

See application file for complete search history.

(56) References Cited

U.S. PATENT DOCUMENTS 3,726,479 A * 4/1973 Leissner et al. ..... 239/233
3,955,762 A * 5/1976 Cassimatis et al. ..... 239/230
4,164,324 A * 8/1979 Bruninga ..... 239/230
4,182,494 A * 1/1980 Wichman et al. ..... 239/230
4,205,787 A * 6/1980 Bruninga ..... 239/230
4,498,626 A 2/1985 Pitchford
5,238,188 A * 8/1993 Lerner et al. ..... 239/230

(Continued)

OTHER PUBLICATIONS

Rain Bird Corp. 2045PJ ½ Plastic Impact Sprinkler [online], publicly available from Rain Bird Corp. prior to Jul. 15, 2004 [retrieved Nov. 1, 2006], 2 pages. Retrieved from the Internet: <URL:http://www.rainbird.com/ag/products/impacts/2045pj.htm>.

(Continued)

*Primary Examiner*—Kevin Shaver
*Assistant Examiner*—Darren Gorman
(74) *Attorney, Agent, or Firm*—Fitch, Even, Tabin & Flannery

(57) ABSTRACT

An impact sprinkler drive is provided by an impact arm or spoon that rotates out of and counter-rotates into a water stream to impact and forward re-align a water emission portion from which the water stream emits. The impact arm is designed to, upon sufficient rotation, interfere with the water stream to reduce back-impact and reverse re-alignment of the water stream. The impact arm may be an impact spoon formed on an impact disc. The impact spoon is configured to increase the energy for forward re-alignment of the water emission portion including an increased length to permit a time delay before water flowing through the spoon applies force away from the water stream. The water acts upon spoon portions positioned at increased radial distances so that the water acts with a greater torque arm to impart rotational energy.

21 Claims, 19 Drawing Sheets

U.S. PATENT DOCUMENTS

| | | | |
|---|---|---|---|
| 5,476,223 | A | 12/1995 | Drechsel |
| 6,142,386 | A | 11/2000 | Spenser |
| 6,193,169 | B1 | 2/2001 | Steinhilber et al. |
| 2004/0262426 | A1 | 12/2004 | Antonucci et al. |

OTHER PUBLICATIONS

Rain Bird Corp. 2045-PJ Maxi-Bird™ Full- or Part-Circle Impact Sprinkler [online], publicly available from Rain Bird Corp. prior to Jul. 15, 2004 [retrieved Nov. 1, 2006], 2 pages. Retrieved from the Internet: <URL: http://www.rainbird.com/landscape/products/impacts/2045pj_maxibird.htm>.

Rain Bird Corp. SLL20VH½ Steel Impact Sprinkler [online], publicly available from Rain Bird Corp. prior to Jul. 15, 2004 [retrieved Nov. 1, 2006], 2 pages. Retrieved from the Internet: <URL: http://web.archive.org/web/20050211205729/www.rainbird.com/ag/products/impacts/sll20vh.htm>.

Photographs of Rain Bird Corp. LF1200 Series Impact Sprinkler, publicly available from Rain Bird Corp. prior to Jul. 15, 2004 [photograph taken Nov. 1, 2006].

Photographs of Rain Bird Corp. SLL20VH½ Steel Impact Sprinkler, publicly available from Rain Bird Corp. prior to Jul. 15, 2004 [photograph taken Nov. 1, 2006].

Photographs of Rain Bird Corp. 2045PJ½ Plastic Impact Sprinkler, publicly available from Rain Bird Corp. prior to Jul. 15, 2004 [photograph taken Nov. 1, 2006].

* cited by examiner

IMPACT SPRINKLER DRIVE SYSTEM

CROSS-REFERENCE TO RELATED APPLICATION

This application claims benefit of U.S. Provisional Application No. 60/588,532, filed Jul. 16, 2004, entitled "Impact Sprinkler Drive System," which is incorporated herein by reference in its entirety.

FIELD OF THE INVENTION

The invention relates to an impact sprinkler and, more particularly, to an impact sprinkler with improved rotation.

BACKGROUND OF THE INVENTION

The use and operation of impact sprinklers is well-known, as are a variety of design limitations and attendant issues. An impact sprinkler rotates in a full or partial circle to distribute water therefrom. A water stream is directed through a nozzle and against a deflector located on a rotation shaft. The water is radially distributed by rotation of the rotation shaft and deflector.

More specifically, the rotation shaft and deflector are periodically and incrementally rotated a short distance as a result of an impact. To permit this rotation, the rotation shaft is rotatably supported by the sprinkler. The water stream outwardly-deflected from the deflector strikes an arm or spoon formed on an impact disc, also rotatably supported by the sprinkler. The water striking the spoon forces the impact disc to rotate so that the spoon is shifted out of the path of the water stream, the shifting overcoming the bias of a spring resisting such movement and contributing to the support of the impact disc. Accordingly, such shifting causes the spring to store energy. Under desirable operating conditions, the water strikes the spoon to cause the impact disc to continue rotating a short distance beyond the water stream.

The spring forces the impact disc into the rotation shaft to cause the rotation of the rotation shaft. The impact disc rotating from the water stream causes a build-up of energy in the spring, and eventually the spring force slows and stops the impact arm, eventually forcing the impact disc to counter-rotate and return towards the water stream. The spoon re-enters the water stream approximately coincident with or shortly before a structure on the impact disc collides with structure on the rotation shaft. This collision causes the rotation shaft to rotate a short distance in the counter-rotation direction. In this manner, the water stream direction is rotationally re-positioned.

The angular amount of rotation of the rotation shaft is dependent on the magnitude of the collision, or the size of impact, between the structures of the impact arm and the rotation shaft. This collision itself is dependent on a number of factors.

For a nozzle providing a low flow speed or volume, the water stream striking the deflector and then the spoon will effect only a short or limited amount of rotational movement by the impact disc. Accordingly, the energy stored in the spring will be low, and the counter-rotation or return of the impact disc will be a similarly short distance. This results in the spoon or impact arm having a low dwell time and re-entering the water stream before a full emission stream pattern develops, thus shortening the throw distance for the sprinkler. The dwell time is generally the amount of time during which the spoon is not aligned with the water stream, and more specifically, the time during which the water stream is free to directly distribute water to the surrounding environment without interference by the spoon.

Additionally, this may result in insufficient rotation of the rotation shaft. A portion of the energy stored by the spring will be lost as the spoon re-enters the water stream, while the remainder will be transferred to the rotation shaft through the collision. The collision is resisted by a certain amount of static friction between the rotation shaft and its support by the sprinkler. If the energy stored by the spring is relatively low, the collision is consequently low also.

In some instances, the energy may not sufficiently rotate the rotation shaft. In such a case, the spoon merely oscillates in and out of the water making little or no collision.

Another problem is that the rotational force for deflecting the impact disc or arm out of the water stream may be excessive. This results in over-rotation of the impact disc, which itself may cause an impact between the impact disc and the rotation shaft in the rotation direction, consequently resulting in rotation of the direction of water stream emission in a direction opposite to that desired, this effect being referred to herein as back-impact.

Previous designs for impact sprinklers tend to suffer from one or more of the foregoing shortcomings. More specifically, dwell-time issues resulting from low water flow may be addressed by using a light spring (i.e., a spring having a low spring constant) for the impact disc. However, this may result in the over-rotation of the impact arm (reverse impact with rotation shaft) and/or insufficient energy stored in the spring arm for causing a forward impact with the rotation shaft. Additionally, the impact disc is supported jointly by the spring and by a stationary support, and a lighter spring results in less support provided by the spring and, consequently, more weight is supported by the stationary support resulting in greater friction between the impact disc and stationary support. As a lighter spring stores less energy for a particular amount of torsional deflection, a greater portion of the return energy is expended in overcoming the friction, thereby reducing the impact energy. Alternatively, utilization of a heavy spring requires a greater force from the water stream to deflect and rotate the impact arm and shortens the dwell time such that the full water stream pattern and throw may be unable to develop.

To improve dwell time, the mass of the impact disc assembly may be increased. However, an increase in mass requires greater water flow to energize, that is, to provide sufficient energy for acceleration and rotation of the impact disc. An increase in impact disc mass also requires a heavier spring, as described above. Accordingly, it has been found that variation of the mass of the impact disc assembly and corresponding variation of the spring constant of the spring generally correlate to balance the impact energy received.

Consequently, there has been a need for an improved impact sprinkler.

DESCRIPTION OF THE PREFERRED EMBODIMENTS

Figure 1:
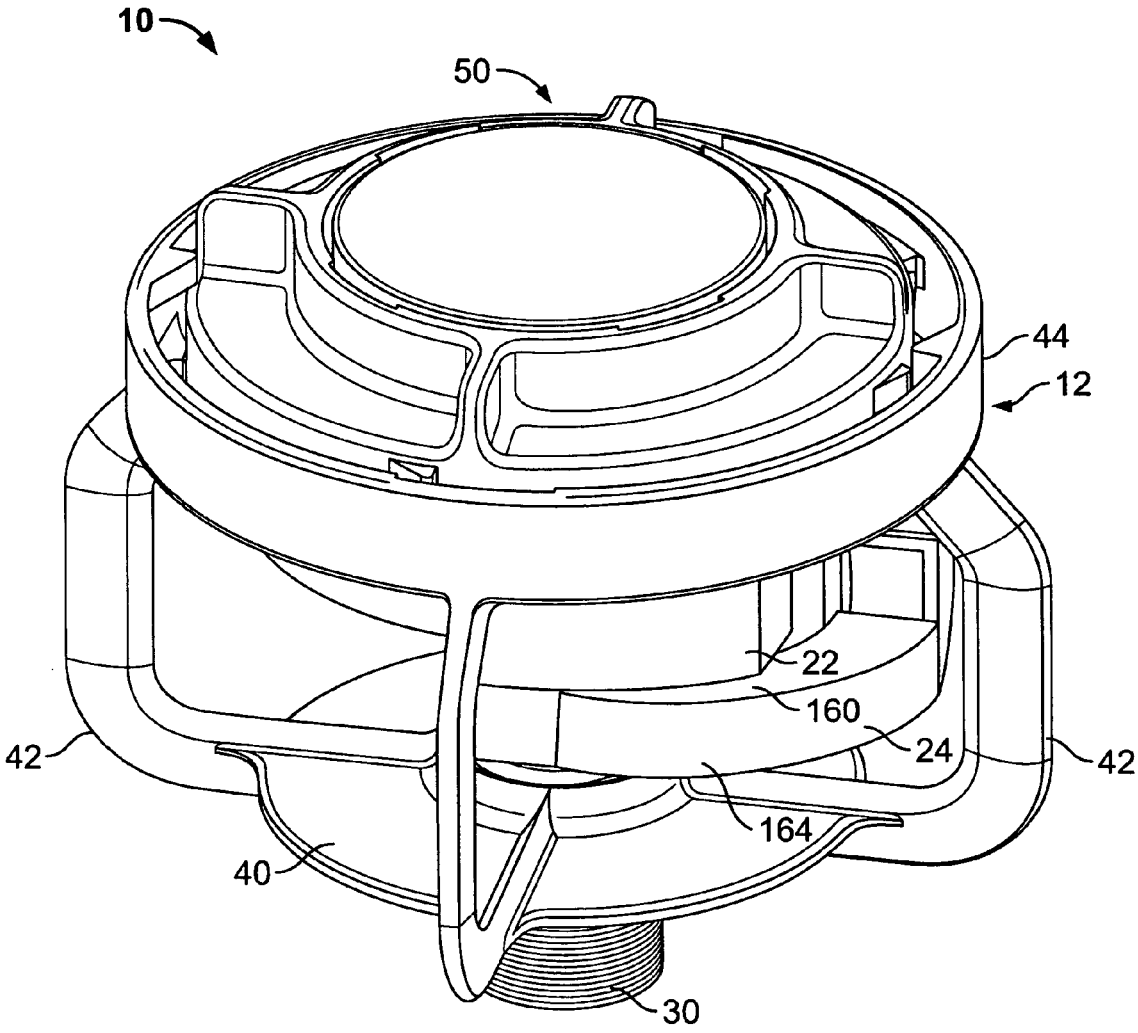
FIG. 1 is a perspective view of an impact sprinkler having a housing supporting a sprinkler assembly including an impact arm and a rotation shaft.
Figure 2:
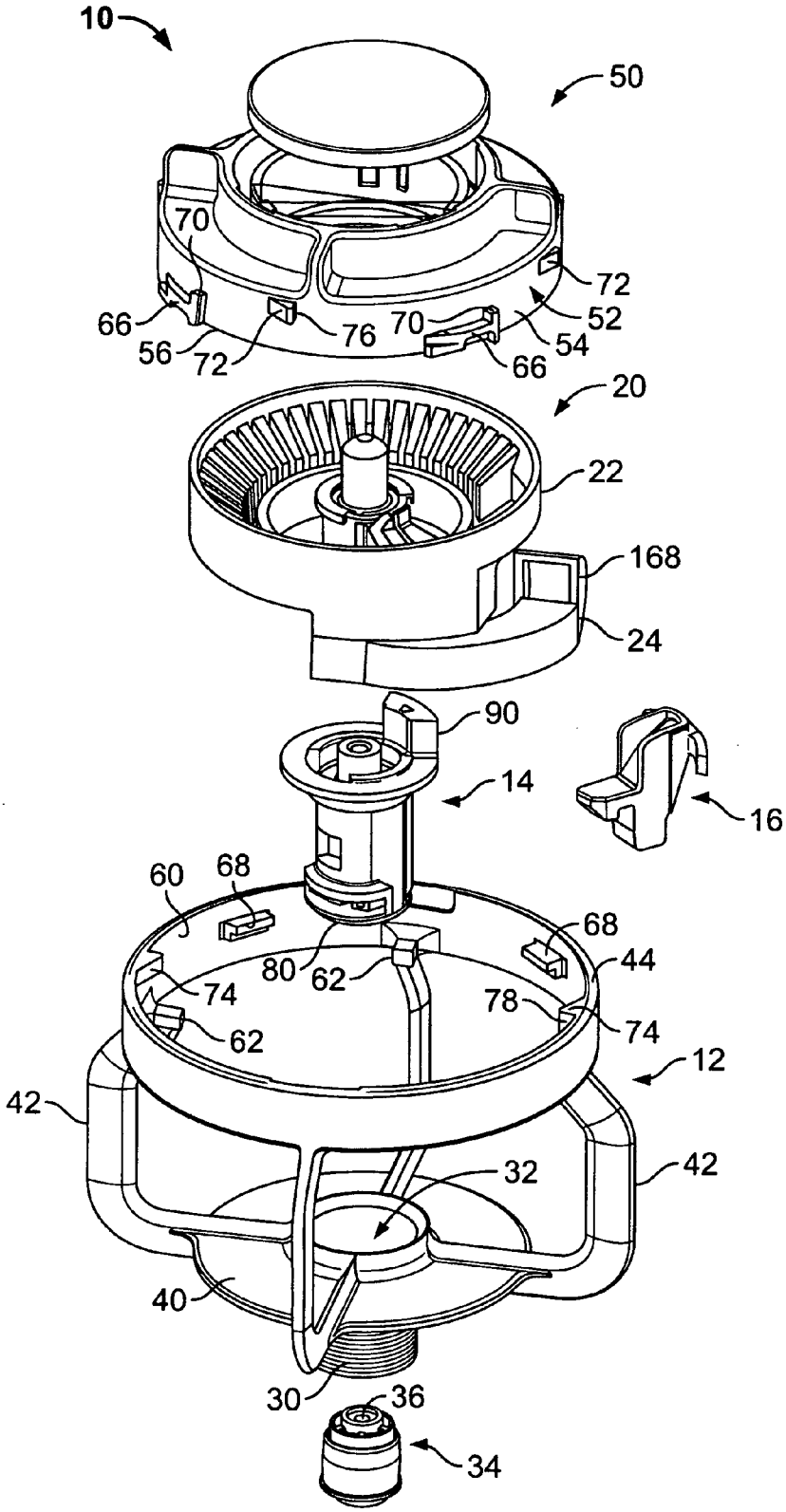
FIG. 2 is an exploded view of the impact sprinkler of FIG. 1 showing the housing, a nozzle received by the housing, and the sprinkler assembly including rotation shaft and a deflector connectable thereto, the impact disc assembly, and a support connectable to the housing for supporting the rotation shaft and the impact disc assembly.

Referring initially to FIGS. 1–7, an impact sprinkler 10 is depicted including a sprinkler assembly 50 supported by a body or housing 12. As can be seen in FIG. 2, the sprinkler assembly 50 includes a rotation shaft 14 having a deflector 16, and an impact disc assembly 20 having an impact disc 22 and an impact arm referred to herein as a spoon 24. The impact disc assembly 20 and rotation shaft 14 are supported by the sprinkler assembly 50 to permit rotation of the impact disc assembly 20 and rotation shaft 14 relative to each other and to the housing 12. As will be described, the impact spoon 24 and a bias member, such as a spring, are configured to maximize an impact between the impact disc assembly 20 and the rotation shaft 14 to re-align the deflector 16, to energize the spoon 24 with a water stream to rotate the impact disc assembly 20 for a desired amount of dwell time, and to minimize the possibility of back-impact which would otherwise cause reverse re-alignment of the deflector 16.

More specifically, the spoon 24 is configured to receive a water stream in a forward drive direction to shift the spoon 24 away from the water stream in a rotation direction, and is configured so that the water stream is received in a reverse drive direction to accelerate the spoon 24 in the counter-rotation direction. The spoon is configured to receive the water stream in the forward drive direction for a sufficient time period for the water stream to impart a desired amount of energy to the impact disc assembly 20 so that, on counter-rotation, the energy is utilized for forward re-alignment of the water stream upon returning to the water stream. The spoon 24 is also configured to utilize the water stream in the reverse drive direction for reverse drive to increase the energization of the impact disc assembly 20 as the spoon 24 re-enters the water stream, thereby increasing the impact between the impact disc assembly 20 and the rotation shaft 14. Furthermore, the spoon 24 is configured to prevent over-rotation of the impact disc assembly 20, which would otherwise cause reverse re-alignment of the water stream. The selection of the spring is coordinated with the spoon configuration to provide a desired dwell time.

As used herein, forward rotation of the impact disc assembly 20 refers to a rotational movement away from a water stream, and counter-rotation of the impact disc assembly 20 refers to a rotational movement towards the water stream. Re-alignment refers to a desired direction of rotational movement by the rotation shaft 14 due to impact thereagainst by the impact disc assembly 20 counter-rotating towards the water stream, and reverse re-alignment refers to an undesired direction of rotational movement by the rotation shaft 14 due to back-impact by the impact disc assembly 20 in the rotation direction away from the water stream. To highlight and clarify, it is noted that excessive forward rotation of the impact disc assembly 20 can result in reverse re-alignment of the rotation shaft 14, though the present forms of impact disc assemblies described herein serve to prevent or restrict this event.

As noted previously, variation of the mass of the impact disc assembly and corresponding variation of the spring constant of the spring generally correlate to balance the impact energy. The spring and its associated spring constant, as well as rotational inertia of the impact disc assembly 20, are principally responsible for the dwell time for the impact disc assembly 20, and the rotational inertia of the impact disc assembly 20 generally correlates to the mass thereof. The shape of the spoon 24 determines how much energy is stored by the impact disc assembly 20 during its forward rotation. The impact energy provided by the impact disc assembly 20 striking the rotation shaft 14 is dependent on the amount of energy stored by the impact disc assembly 20 during the forward rotation, and the amount of energy imparted as a reverse drive to the impact disc assembly 20 as the spoon 24 re-enters the water stream.

The impact sprinkler 10 is commonly installed as part of a larger system for irrigating an area by incorporating a plurality of sprinklers 10. The larger system includes a water source (not shown) for delivering water to each of the sprinklers 10 via distribution pipes or conduits (not shown). The sprinkler body or housing 12 connects to the distribution conduit for receiving water therethrough. More specifically, the housing 12 includes an externally threaded neck 30 threadably received within the conduit. In the present embodiments, the neck 30 defines an interior tubular passage 32 with structure for receiving and securing a nozzle 34 therein, such as by a snap fit.

When the neck 30 is secured to the distribution conduit, the nozzle 34 is positioned within the conduit and in the flow of water. The nozzle 34 is selected to provide desired flow characteristics based on expected water source conditions and includes an inlet (not shown) and an outlet 36 for directing water in an upward stream. It should be noted that, alternatively, the nozzle 34 may be secured and rotate with the rotation shaft 14, in which case a pressurized dynamic seal between the neck 30 and rotation shaft 14 is preferably present.

As depicted, the housing 12 includes a bottom plate 40 extending laterally from the neck 30 and protective ribs 42 which extend laterally and then vertically from the neck 30 and the bottom plate 40. At an uppermost portion, the ribs 42 are connected to a mount ring 44.

The mount ring 44 and sprinkler assembly 50 include structure cooperating to secure the sprinkler assembly 50 to the housing 12. The sprinkler assembly 50 includes a support 52 having a generally cylindrical outer surface 54 having a lower edge 56. The mount ring 44 includes a generally cylindrical inner surface 60 on which is formed support posts 62 extending radially inward. The sprinkler assembly 50 is received within the mount ring 44 so that the lower edge 56 abuts and is supported by the support posts 62. Additionally, the outer surface 54 includes assembly shoulders 66 extending radially outward therefrom, and the mount ring 44 includes retainers 68 extending radially inwardly. With the sprinkler assembly 50 received within the mount ring 44, the assembly shoulders 66 align below the retainers 68. The sprinkler assembly 50 is then rotated relative to the mount ring 44 so that the assembly shoulders 66 are positioned below and against the retainers 68. The assembly shoulders 66 include an upward portion 70 forming a stop against which the retainers 68 are positioned when the sprinkler assembly 50 is secured therein.

Rotating the sprinkler assembly 50 relative to the mount ring 44 releasably secures the sprinkler assembly 50 therein. More specifically, the outer surface 54 of the support 52 includes ramps 72 which cooperate with mount ring ramps 74 such that rotating the sprinkler assembly 50 cams the ramps 72, 74 against each other. Coincident with or immediately prior to the retainers 68 contacting the stops 70, the ramps 72 clear the ramps 74. Each of the ramps 72, 74 have respective stop surfaces 76, 78 generally radially aligned such that, when the ramps 72 are rotated clear of the ramps 74, the stop surfaces 76, 78 are in a confronting relationship to secure the sprinkler assembly 50 within the mount ring 44 by restricting or preventing the sprinkler assembly 50 from rotating in an opposite direction.

The mount ring 44 secures the support 52 so that the housing 12 supports the sprinkler assembly 50. As noted above, the sprinkler assembly 50 includes the impact disc assembly 20, and the rotation shaft 14, both of which may rotate relative to each other and to the support 52 secured with the housing 12. During operation, the nozzle 34 secured with the housing 12 directs incoming water flow against the deflector 16 located on the rotation shaft 14, and the water is then distributed from the deflector 16. More specifically, the rotation shaft 14 has a lower end 80 located proximate the nozzle outlet 36, and the deflector 16 is secured to the lower end 80 such that the water stream from the outlet 36 flows into and against the deflector 16.

In simple terms, the water stream from the deflector 16 effects the operation of the sprinkler 10. The deflector 16 and its rotation shaft 14 in a particular position direct water in a radial direction from the sprinkler 10. With the impact disc assembly 20 aligned with the water stream from the deflector 16, water flows into an inlet 100 of the impact spoon 24. After a short period of time in which the impact disc assembly 20 is energized by the water stream, the impact disc assembly 20 rotates out of the water stream, thereby storing energy in a bias member or spring (not shown). After a period of rotation, the impact disc assembly 20 slows, stops, and counter-rotates to return towards the water stream.

The period of rotation and counter-rotation by the impact disc assembly 20 is known as the dwell time, and during this dwell time the water stream emits from the deflector 16 in a radial direction to irrigate or distribute water therefrom. Initially, the water is distributed a short distance, and subsequently is distributed a greater distance as the spoon moves out of the water stream and the water stream progresses towards a maximum throw distance. The amount of dwell time necessary for the water stream to form a pattern for the maximum throw distance depends on a variety water flow characteristics including pressure and volume.

The rotation shaft 14 has an upstanding arm 90 received within a partially circular cavity 92 (FIG. 3) formed in the impact disc assembly 20 and defined by a bridge 94 spanning from a hub 96 to a disc body 98. The arm 90 travels along the cavity 92 during the rotation and counter-rotation of the impact disc assembly 20 relative to the rotation shaft 14. When the disc assembly 20 returns into the water stream, the bridge 94 strikes the arm 90, and the kinetic energy of the disc assembly 20 is partially transferred to the rotation shaft 14. This effects an incremental or discrete rotational movement so that the rotation shaft 14 and deflector 16 are re-aligned to distribute in a new radial direction.

Figure 5:
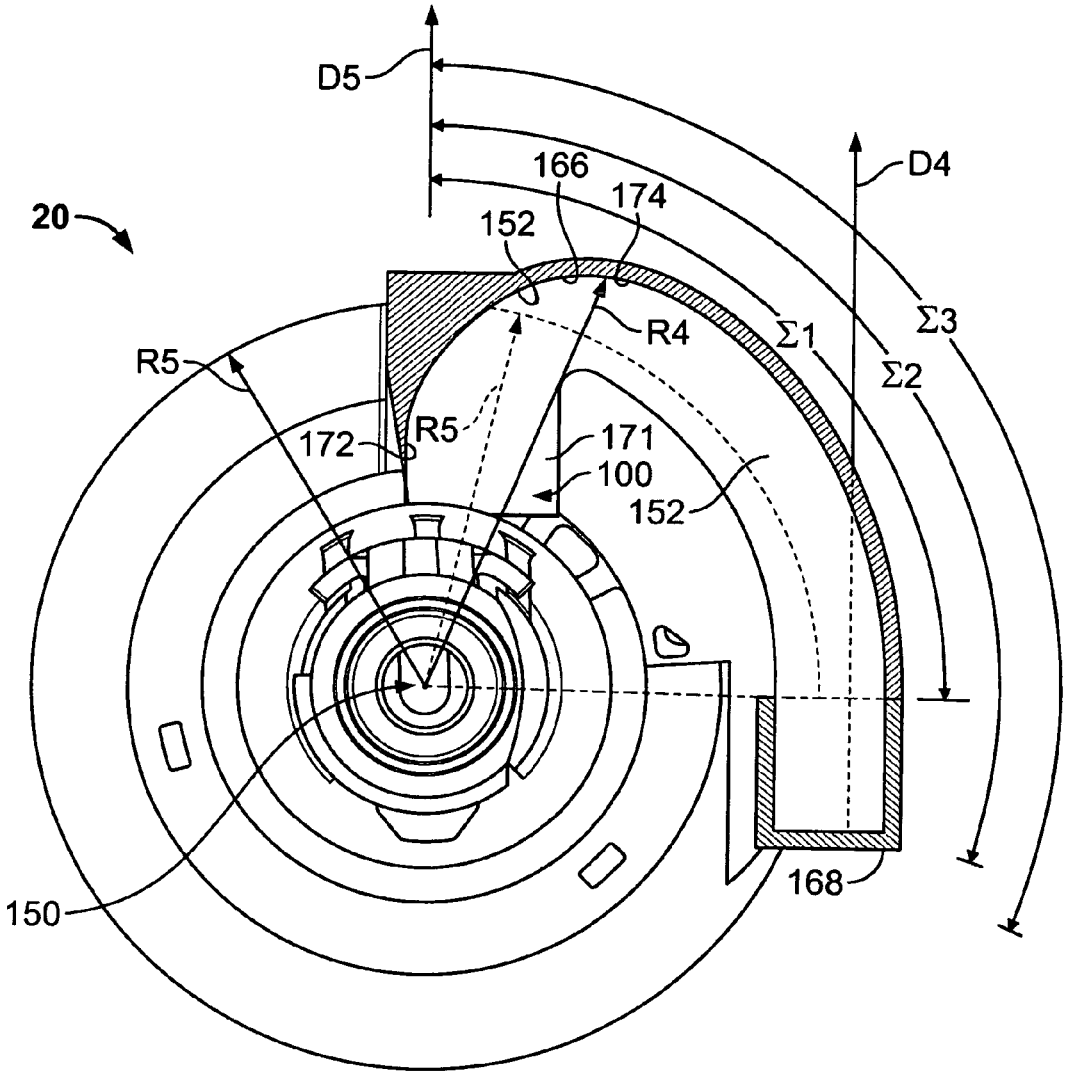
FIG. 5 is a bottom plan view of the impact disc assembly and rotation shaft of FIG. 4 showing the impact arm in cross-section.

As described above, the spoon 24 receives a combination of forward drive energy and reverse drive energy from the water stream. Once the spoon 24 re-enters the water stream, the water begins flowing through the spoon 24. As the spoon inlet 100 initially re-enters the water stream, a portion of the spoon 24 is struck by the water to provide additional energy to drive the impact disc assembly 20 into the impact with the rotation shaft 14. The sum of the forces of each finite portion of the water stream in the spoon 24 provides reverse drive to the spoon 24 and impact disc assembly 20 until the water stream contacts an upstream discharge portion, described herein and referred to as an exit flow portion 168 (FIG. 5). While the water striking the reverse drive portions of the spoon 24 continues to provide reverse drive to the spoon 24, the water striking the other portions and the exit portion 168 provide forward drive. The reverse drive is not immediately counteracted by the forward drive so that it may be at some point after the water strikes the exit flow portion 168 that the sum of the forces from the water stream provides a forward drive or rotation to the spoon 24. For a particular nozzle, the speed of the water into the spoon 24 is generally dependent on the nozzle pressure. For a low pressure water stream having a low velocity or speed, the water stream may not contact the exit flow portion 168 until a short period after the impact occurs. Conversely, a high pressure water stream has a high velocity or speed, and the water stream may contact the exit flow portion 168 prior to the impact.

As will be discussed in greater detail below, the spoon 24 is configured to increase the reverse drive effect on the impact disc assembly 20 during re-entry to the water stream. The impact disc assembly 20 generally does not begin attempting to shift from the water stream until the water flowing therethrough strikes the downstream exit flow portion 168. The length of the spoon 24 allows a time delay for water to strike the exit flow portion 168. One benefit of this time delay is that water does not strike the exit flow portion 168 as quickly, preferably not until after the impact occurs, thereby allowing the reverse drive to increase the impact and lessens the forward drive effects from water flowing through the spoon 24 that would otherwise reduce the impact energy. Another benefit is that a greater amount of water, or a greater segment of the water stream, is received by the spoon 24 so that, once the spoon 24 does shift, the increased amount of water continues to energize the impact disc assembly 20 until the water has exited through the exit flow portion 168.

The configuration of the impact spoon 24 facilitates the above-described operation. More specifically, the impact spoon 24 is configured to maximize the energy imparted by the water stream passing therethrough. For comparison purposes and with reference to FIG. 20, a configuration for a prior art impact spoon 110 mounted or formed on an impact disc 111 is depicted. As shown, the spoon 110 includes a first flow portion 112 and a second flow portion 114. The water stream is directed from a deflector, such as the above-described deflector 16, in the direction of arrow I for impacting the first flow portion 112. The first flow portion 112 has an inner surface 115 including an inlet section 116, a relatively straight section 118, and an arcuate section 120 including an outlet section 122.

The spoon 110 includes a lead-in surface 124 which is struck by the water directed in the direction of arrow M. Though the lead-in surface 124 provides a slight reverse drive, in a direction Δ, the bluntness of the lead-in surface 124 with respect to the water stream in the direction M causes a loss of energy for the water contacting there. Consequently, when the spoon 110 counter-rotates so that the water stream is directed into the spoon 110, the water stream is slower, and the amount of available reverse drive is reduced.

Additionally, the lead-in surface 124 reduces the forward drive energy for the spoon 110. As the spoon 110 rotates in the rotation direction and prior to the spoon 110 passing fully away from the water stream, the lead-in surface 124 again passes through the water stream. By doing so, a reverse-drive force is applied by the water stream against the lead-in surface 124, thereby decreasing the forward drive of the spoon 110.

As noted above, the straight section 118 provides a desirable counter-rotation driving force from the water stream. As the spoon 110 returns to the water stream immediately prior to impacting with the rotation shaft 14, water striking the straight section 118 provides additional energization to the returning spoon 110 for assisting in delivering impact energy against the rotation shaft 14. Moreover, the straight section 118 being angled or contoured in such a manner is generally beneficial as the radially directed water stream is necessarily re-directed through the spoon 110. Toward this end, the shape of the straight section 118, as well as a portion of the arcuate section 120, which tend to direct the spoon 110 in the counter-rotation direction Φ, are designed to avoid excessive turbulence and head loss (wasted energy in the form of heat) while re-directing the water stream through the spoon 110.

The arcuate section 120 generally spans angle α and has a radius of curvature of R1. As can be seen, the outlet section 122 directs the water somewhat inwardly, in the direction of arrow D1. The water then transitions into and strikes an inner surface 126 of the second flow portion 114.

The inner surface 126 includes a generally straight section 130, a second arcuate section 132, and an outlet section 134, each being angled or contoured so that water striking thereagainst produces forward rotation drive. The generally straight section 130 is angled so that water received along the inner surface 126 follows the direction of arrow D2. As can be seen, water exiting the outlet section 122 of the first flow portion 112 and following the direction of arrow D1 is redirected outward by the straight section 130.

The water passes from the straight section 130 to the second arcuate section 132. The second arcuate section 132 redirects the water, thereby deriving energy from the water, such that water is then emitted from the spoon 110 in the direction of arrow D3. The second arcuate section 132 has a radius of curvature of R2 and spans an angle β.

Figure 20:
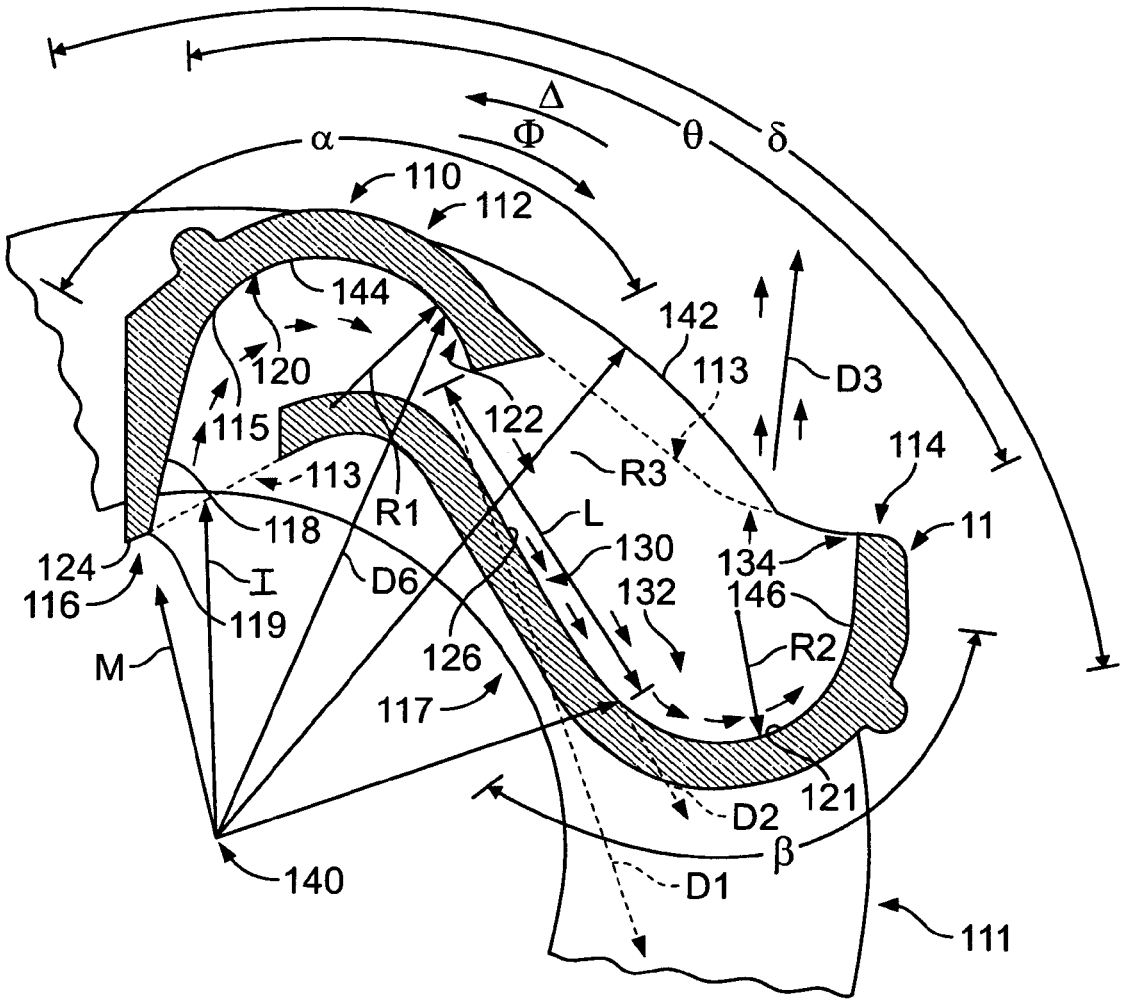
FIG. 20 (Prior Art)
FIG. 20 is a fragmentary bottom plan view of a prior art impact disc assembly showing a prior art impact arm in cross-section.

In the present form, angle α is 157 degrees and the radius of curvature R1 is 0.260 inches. As water flows along the straight section 130, the average length of travel is represented by length L and is approximately 0.50 inches. The radius of curvatue R2 of the second arcuate section 132 is 0.250 inches, and the angle β is approximately 150 degrees. Accordingly, the average travel distance for water through the spoon 110 is approximately 2.41 inches. The impact disc 111 has a center of rotation 140 and a radius R3 to a perimeter edge or surface 142 formed thereon. The center of rotation 140 is approximately coincident with the origin point of the water stream from the deflector, though it may be offset somewhat depending on the configuration of the deflector. The radius R3 is approximately 1.14 inches. The first flow portion 112 receives water at an initial point 119, and the second flow portion 114 includes a point 121 which is the point of greatest angular distance from the initial point 119, these points providing an angle δ (FIG. 20). This angle δ is approximately 85 degrees.

As stated above, the impact spoon 24 is configured for the water to follow a longer path or travel distance through the spoon 24 therefrom than the path or travel distance through the spoon 110 of the prior art. Additionally, the force acting on the spoon 24 produces a torque dependent on the distance from a center of rotation 150 (FIG. 3) of the impact disc assembly 20, and the spoon 24 is configured such that a greater portion of the spoon 24 is positioned at a greater distance from the center of rotation 150 than is present in the prior art spoon 110.

With reference to FIGS. 3–7, the spoon 24 and impact disc 22 are depicted. In general, the impact disc 22 is substantially identical in mass, size including radius, and design to the prior art impact disc 111.

The spoon 24 includes an inner surface 152 along which the water stream travels through the spoon 24. The spoon 24 generally includes a top wall 160, a bottom wall 162, an outer wall 164 having an inner surface 166, and an exit flow portion 168 having an inner surface 170 (FIG. 6) for turning the water for emission, as well as deriving energy from the water stream. The spoon 24 includes an inlet section 100 (FIGS. 5 and 7) formed by the walls 160, 162, and 164. As can be seen in FIG. 7, the lead-in surface 124 of the prior art spoon 110 has been eliminated to reduce or eliminate the above-described energy and head losses. The inlet section 100 includes a ramp surface 171 (FIG. 7) assisting in directing the radially directed water from the deflector 16 into and along the spoon 24. The inlet section 100 also includes a reverse-drive section 172 formed on the inner surface 166 of the outer wall 164 providing energy for counter-rotation of the impact disc assembly 20 when the spoon 24 re-enters the water stream, immediately prior to impact with the rotation shaft 14.

Figure 3:
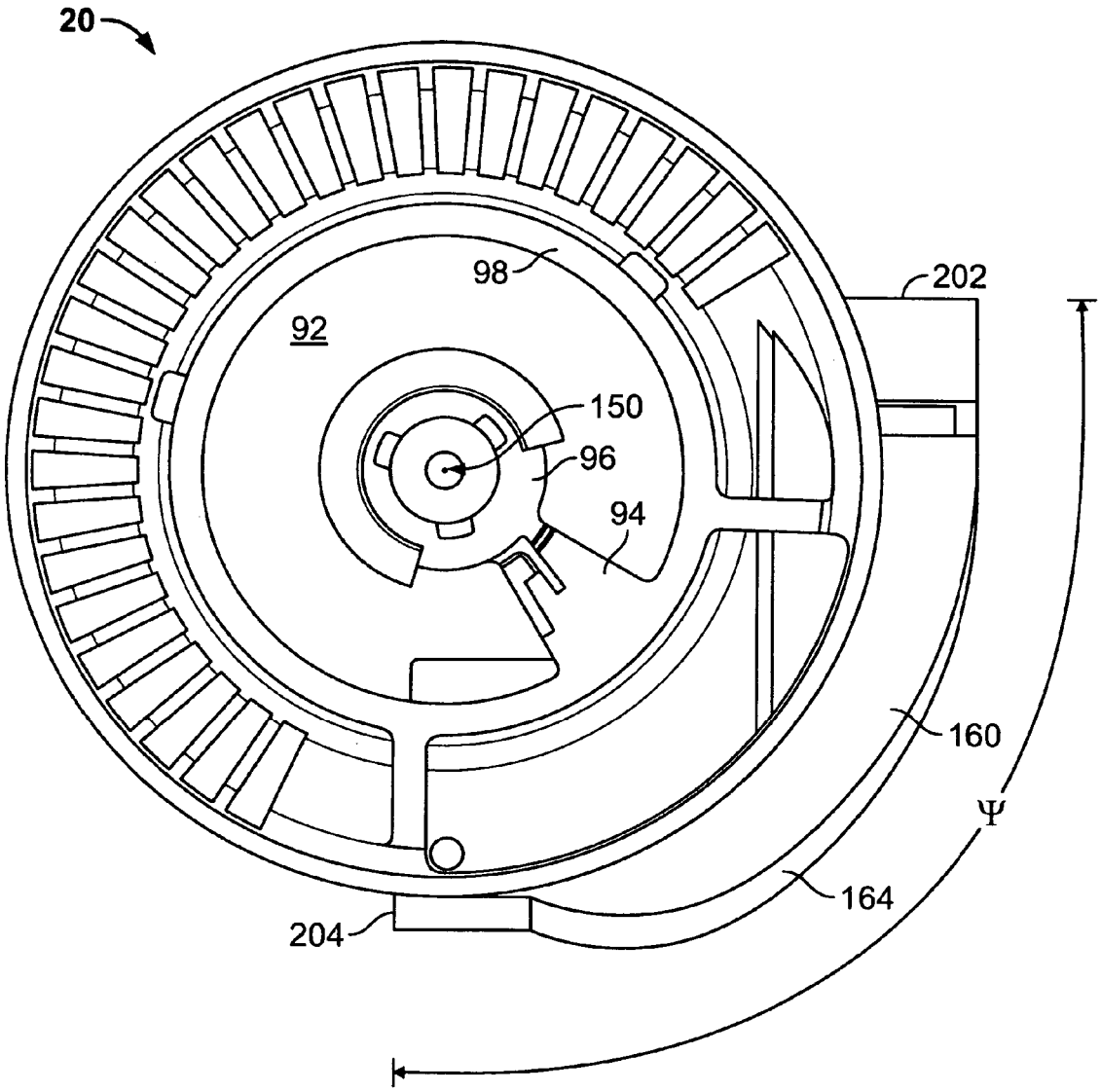
FIG. 3 is a top plan view of the impact disc assembly of FIG. 2.

The reverse-drive section 172 transitions smoothly to a forward drive section 174, also formed on the inner surface 166. As can be seen in FIGS. 3 and 5, the forward drive section 174 is positioned at a varying distance R4 from the center of rotation 150, but in any event generally greater than a radius R5 of the impact disc 22 itself. As the water flows along the forward drive section 174, a force from the water acts upon the spoon 24 resulting from the cohesion forces of the water molecules, the adhesion forces between the water and the inner surface 166, and the kinetic energy of the water. As the water is acting at a distance, that of distance R4, from the center of rotation 150, the force from the water produces a torque, thereby imparting forward drive energy to the impact disc assembly 20 and spring.

As can be seen in FIG. 20 for the prior art spoon 110, a portion 144 of the first flow portion 112 and a portion 146 of the second flow portion 114 are positioned respective distances from the center of rotation 140, though neither is positioned a distance much greater than the radius R3, the outer radius of the impact disc being 1.14 inches. Additionally, the force by the water flowing against the inner surfaces 115 and 126 of the first and second flow portions 112, 114, respectively, of the prior art spoon 110 produces a torque in proportion to the finite distances along the inner surfaces 115, 126, of which only small portions of the prior art spoon 110 are positioned at the maximum distances of the portions 144, 146. As also can be seen in FIG. 20, the water in the prior art spoon 110 flows through a total angle Θ, approximately 75 degrees, prior to entering the second arcuate section 132 in which the water is turned for emission.

With reference to FIG. 5, the spoon 24 allows water to travel through an angle Σ1 prior to entering the exit flow portion 168. This angle Σ1 is preferably approximately 90 degrees, which is 15 degrees greater than the angle Θ for the prior art spoon 110. Combined with the torque due to the distance of the inner surface 166 from the center of rotation 150, it is clear that the spoon 24 produces a greater torque than the spoon 110. In addition, and as previously stated, the angle δ for the prior art spoon 110 between its leading or initial point 119 of water contact and the point 121 of its maximum angular distance on the second flow portion 114 is approximately 85 degrees. In comparison, the spoon 24 has comparable angles Σ2 and Σ3 corresponding to different portions of the exit flow portion 168, Σ2 being preferably approximately 100 degrees and Σ3 being preferably approximately 105 degrees.

Figure 6:
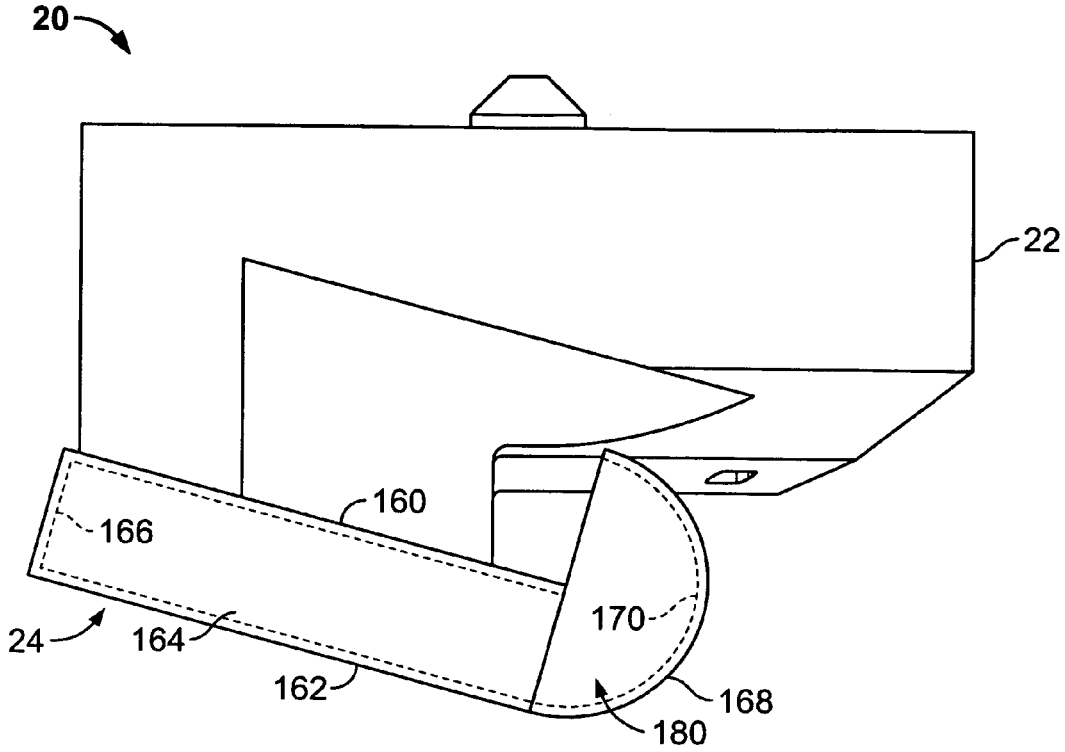
FIG. 6 is a side elevation view of the impact disc assembly of FIG. 4 showing the impact disc and the impact arm.
Figure 7:
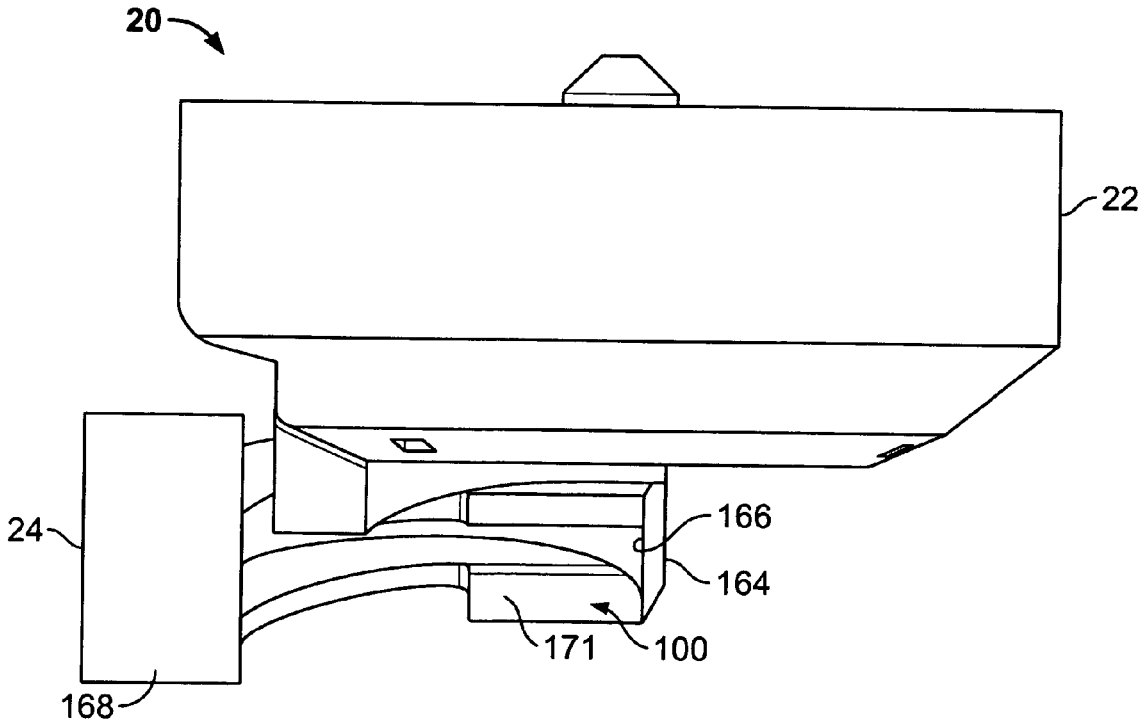
FIG. 7 is a side elevation view of the impact disc and impact arm of FIG. 6.
Figure 8:
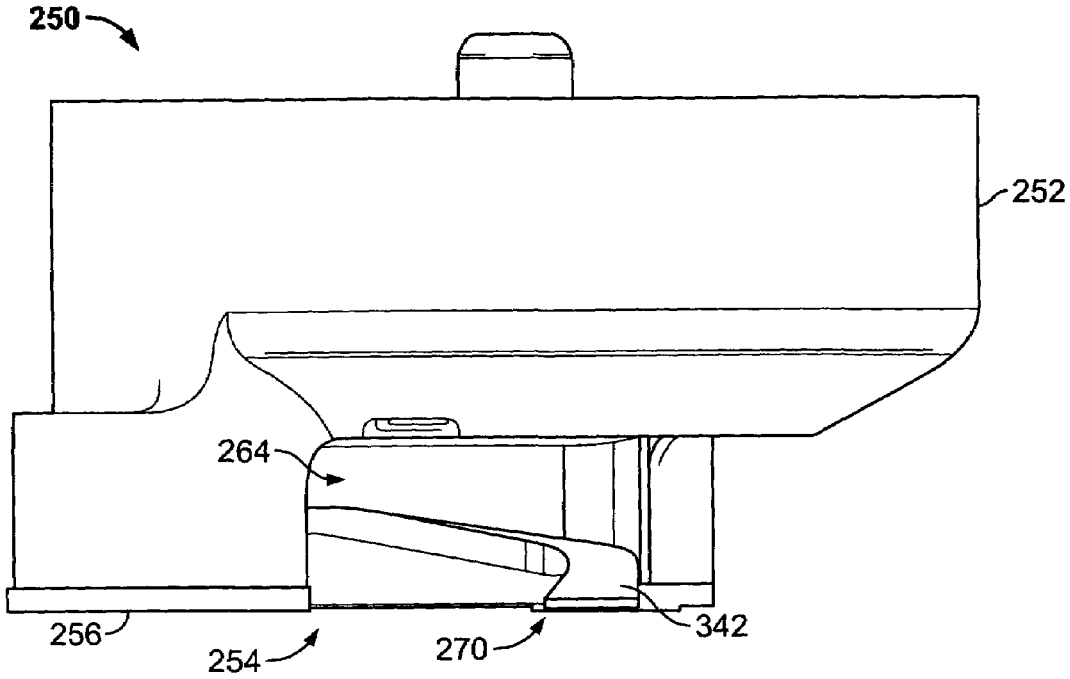
FIG. 8 is a side elevation view of an alternative configuration of an impact disc assembly.
Figure 9:
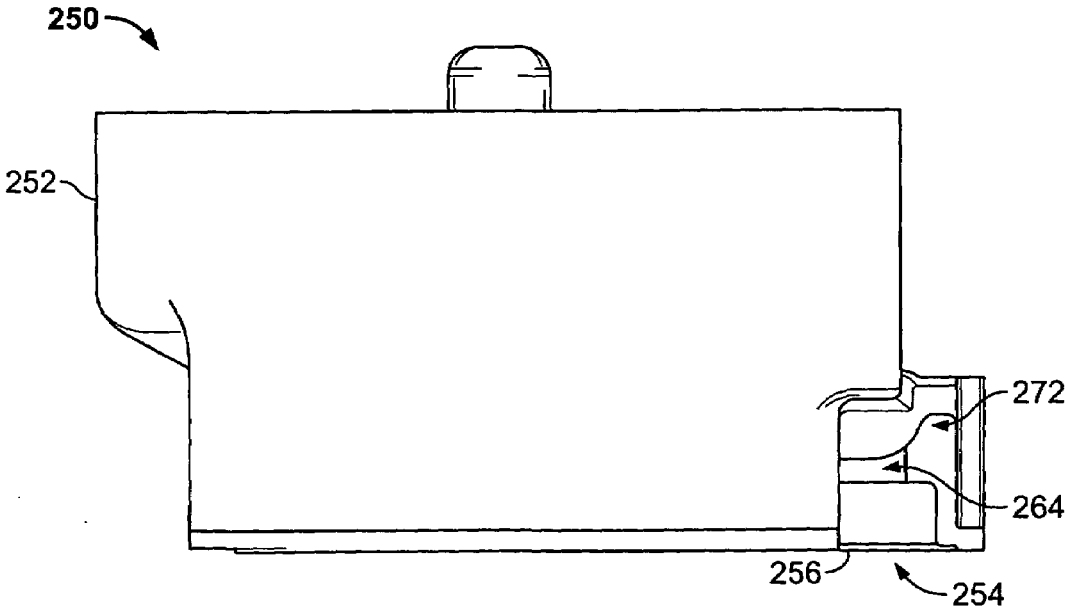
FIG. 9 is a side elevation view of the impact disc assembly of FIG. 8.

As is depicted in FIGS. 6 and 7, it can be seen that the spoon 24 angles downward from the inlet section 100 and prior to reaching the exit flow portion 168. The downward angle increases the length of the spoon 24 within an angular extent Ψ of the spoon 24, between leading end 202 and trailing end 204, shown in FIG. 3. The exit flow portion 168 then makes a turn, approximately 90 degrees, for emitting the water with an upward trajectory which assists in utilizing the water therethrough for irrigation or distribution purposes and reduces or eliminates the possibility that the water is merely deposited only relatively close to the sprinkler 10.

While the prior art spoon 110 makes such a turn (slightly less than 180 degrees) in its second arcuate section 132, the exit flow portion 168 makes the turn in a plane that is orthogonal to a plane of flow through the forward drive section 174, while the flow of water through the second arcuate section 132 is in generally the same plane as the water through the balance of the spoon 110. In this manner, the angle Σ1 may be greater than the angle Θ, as described above, and an exit direction D4 of water therefrom remains generally parallel to a direction D5 as stream emits directly from the deflector 16. The directions D4 and D5 are approximately parallel, and are separated by preferably approximately 1.25".

The exit stream from the exit flow portion 168 produces an additional torque that is fully utilized to produce stored energy for the impact disc assembly 20. The direction D4 for the water stream from the exit flow portion 168 is positioned outside of the impact disc 22. As can be seen in FIG. 20, the prior art spoon 110 produces an exit stream along the direction D3. The direction D3 is positioned at a much lower distance from the center of rotation 140 of the disc 111 and the direction D3 is positioned from the center of rotation 150 of the disc 22. As these distances produce respective torque arms, the torque for equal water streams is much greater in the spoon 24 having the exit flow portion 168 than for the prior art spoon 110.

The exit flow portion 168 turning the water in a second plane has an additional benefit. As the water transitions from the forward drive section 174 to the exit flow portion 168, the water tends to be outboard from the center of rotation 150 and flowing along the bottom wall 162. Were the exit flow portion 168 merely rotated from the orientation depicted to turn in the same plane, the water would collide in an orthogonal direction to the inner surface 170 of the exit flow portion 168. While it may appear that this would impart a great amount of energy thereto, the negative pressure on the flow of water more than counteracts this and restricts the flow of water through the spoon 24, and the collision causes a loss of pressure (energy lost due to heat). An entrance portion 180 of the exit flow portion 168 angles upward from the bottom wall 162, as can be seen in FIGS. 5 and 6. In both the spoon 24 and the prior art spoon 110, the radius of curvature for the exit flow portion 168 and the second arcuate section 132 should be large enough to allow the smooth transition. As can be seen for the prior art spoon 110 of FIG. 20, this transition is made smooth by the exit section 122 directing the water inwardly. As the exit flow portion 168 is positioned at a greater radial distance, the turn in the second plane is possible (FIG. 2), and the radius of the inner surface 170 is greater than the radius R2 for the second arcuate section 132 of the prior art spoon 110. As a portion of the exit flow portion 168 is positioned at a distance greater than outside the radius itself R5 (FIG. 50, water striking the inner surface 170 has a greater torque.

During operation of the sprinkler 10, it is desired to maximize the energy derived by the spoon 24 from the water stream and maximize the dwell time, balanced against minimizing the likelihood of a back-impact due to over-rotation of the impact disc assembly 20. The described configuration of the spoon 24 provides substantially more impact energy than does the prior art spoon 110, while doing so with a similarly-sized, in an angular sweep, structure. As described, the inner surface 166 along which the water pulls is positioned at the distance R4 from the center of rotation 150 greater than the distance for comparable surfaces for the prior art spoon 110 such that greater torque is produce.

As was noted earlier, it is beneficial that the angle Σ1 of the spoon 24 is greater than the angle Θ for the prior art spoon 24. Though it may seem incongruous, it is considered beneficial to utilize the exit flow portion 168 to reduce the length of the spoon 24. Such is resolved by first noting that incorporation of the exit flow portion 168 creates extended travel distance by water flowing through the spoon 24, yet also increases the energy that can be derived from the water stream, and by secondly noting that utilization of the exit flow portion 168 while not substantially increasing the angular sweep of the spoon 24 allows similar forward rotation of the spoon 24 and impact disc 22, as will be discussed below.

Figure 4:
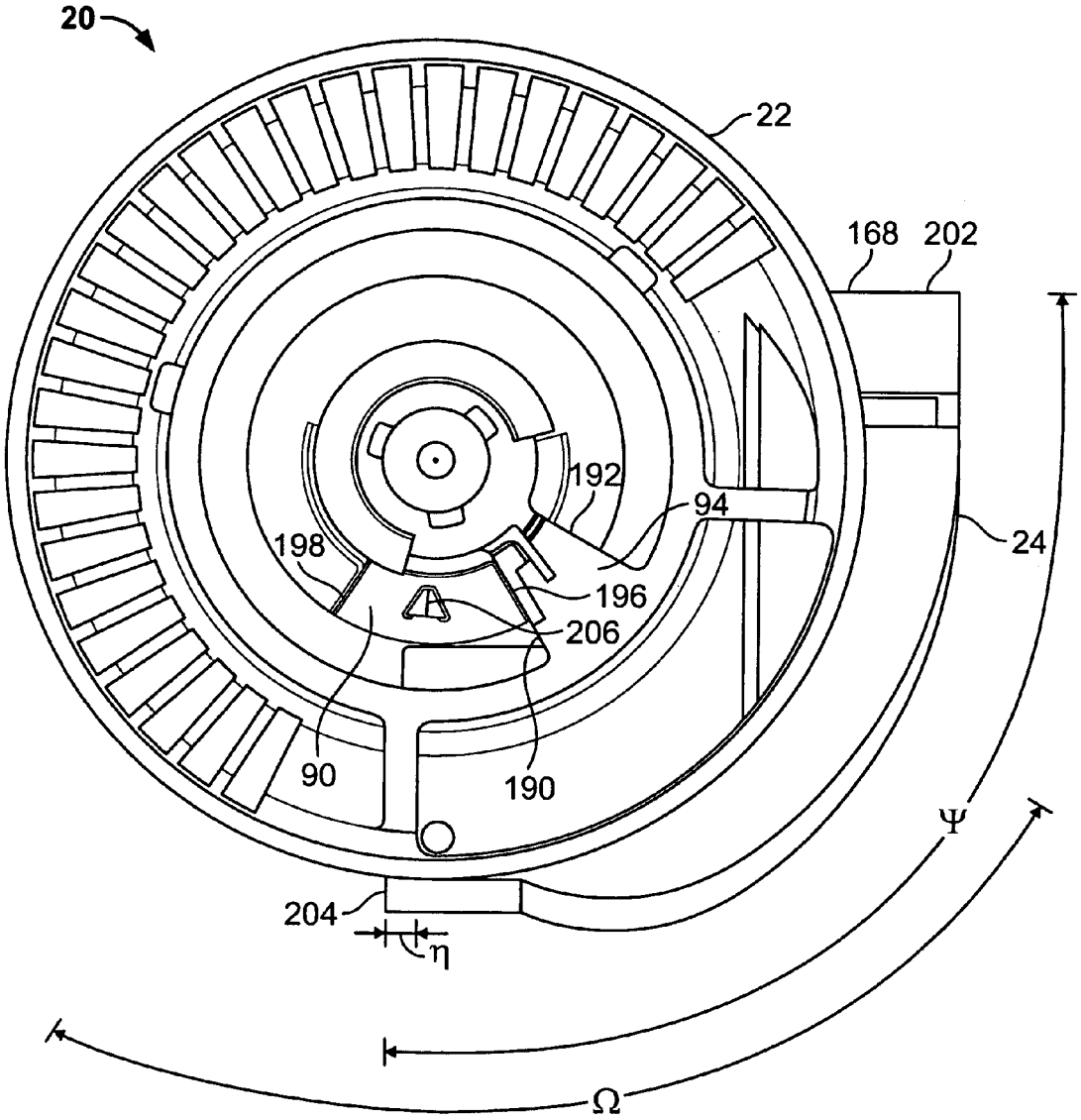
FIG. 4 is a top plan view of the impact disc assembly engaged with the rotation shaft of FIG. 2.

The impact disc assembly 20 is constructed to minimize the likelihood of back-impact, balanced against providing the greatest travel distance by the water within the spoon 24 and, specifically, the greatest distance prior to the water striking the exit flow portion 168. Described above, over-rotation and back-impact may result in the bridge 94 contacting the upstanding arm 90 of the rotation shaft 14 in the rotation direction, resulting in reverse re-alignment of the rotation shaft 14 and deflector 16. As can be seen in FIG. 4, the bridge 94 has a first impact surface 190 which strikes against a first reaction surface 196 of the upstanding arm 90 for the desirable forward re-alignment of the rotation shaft 14. The bridge 94 also has a second impact surface 192 which may strike a second surface 198 on the upstanding arm 90, to cause the back-impact. To minimize this likelihood, the bridge 94 is constructed so that the surfaces 190, 192 combined with the surfaces 196, 198 form a relatively small angular sweep Ω. An indicia 206 indicates the direction and position from which the water stream is discharged by the deflector 16, and the inlet section 100 (see FIG. 5) is aligned with the indicia 206.

As stated, it is also desired to have the greatest travel distance by the water within the spoon 24. More specifically, the time delay before the water strikes the exit flow portion 168 correlates to the travel distance by the water within the spoon 24. The impact disc assembly 20 begins shifting away from the water stream shortly after the water strikes the exit flow portion 168. It is desired to provide a time delay sufficient to allow the water stream to act upon the reverse drive portions such as the straight section 118 to maximize the impact energy between the impact drive assembly 20 and the rotation shaft 14, which occurs prior to the impact disc assembly 20 shifting away from the water stream. As described herein, the configuration of the spoon 24 provides additional length than the prior art spoon 110, thus also providing a greater time delay to improve the impact energy.

As noted above, the impact disc 22 with the exception of the spoon 24 is generally the same as the prior art impact disc 111 in terms of mass, size, and design. Also, the spring utilized as the bias member to store the energy from the forward rotation of the impact disc assembly 20 principally determines the dwell time, and the shape of the spoon 24 principally determines how much energy is stored in the spring. The greater the spring constant, with all other values held constant, the shorter the dwell time. For the prior art impact disc 111 and spoon 110, the spring has a spring constant of approximately $1.2\times10^{-4}$ inch-pounds/degree of rotation, and is fixed with a preload of 150 degrees rotation. As the spoon 24 derives more reverse drive energy from the water stream at it re-enters the water stream, the impact disc assembly 20 is able to operate in water flows with lower energy or, more precisely, a lower pressure and flow rate. This also allows the spring constant to be reduced, preferably to approximately $6.5\times10^{-5}$ inch-pounds/degree of rotation, with a preload of approximately 190 degrees. Thus, sprinkler 10 is able to operate at low pressures, in the range of 10–15 psi, while the prior art sprinkler tends to behave erratically or undesirably below approximately 20 psi when using low-flow rated nozzles.

The sprinkler 10 operates at a faster rotational rate than those of the prior art. The spoon 24 has a higher energy imparted thereto in the reverse drive direction during re-entry by the spoon 24 into the water stream and has a greater time delay before the water strikes the exit flow portion 168 so that the water stream is able to maximize the energization to the reverse drive portions, such as the straight section 118, in the spoon 24. Together, these factors enable the spoon 24 to have a higher impact between the bridge 94 and upstanding arm 90 of the rotation shaft 14. Therefore, each impact therebetween causes a greater rotational re-alignment for the deflector 16. By way of example, a prior art sprinkler operating at 30 psi makes a full revolution in approximately 80 seconds. The sprinkler 10 described herein makes a similar full revolution in approximately 30 seconds.

The operation of the sprinkler 10 benefits by making the full revolution in the shorter time period of approximately 30 seconds. During operation in the field, it is not uncommon for bugs, dirt, or other particulate material to intrude between components of the sprinkler 10. Each of these intrusions retards the rotation of the sprinkler, and may cause premature wear. In any event, a number of the components will experience wear over time and usage. The faster sprinkler 10 has greater power for rotating the rotation shaft 14 and deflector 16. This power may be utilized to overcome the impediments resulting from intrusive materials, friction, and worn surfaces. Another benefit is that the additional power created results in the sprinkler 10 operating properly at a lower flow pressure. Consequently, smaller nozzles may be used with the sprinkler 10 that would typically result in stalling by the commonly known sprinklers of the prior art if used therewith.

As noted, the impact disc assembly 20 and the prior art impact disc 111 generally do not begin shifting in the rotation direction Φ until the water stream has passed into and struck the exit flow portion 168. This allows the time delay for the spoon 24 to receive a greater amount of the water stream, a greater water stream segment, so that, once the spoon 24 does shift, the water continues to energize the impact disc assembly 20 until the water has exited through the exit flow portion 168. To some degree, energy is balanced by greater distance traveled so that the resultant energy imparted to the impact disc assembly 20 is generally similar to that of the prior art disc 111 and spoon 110.

Referring now to FIGS. 8–15, an alternative form of an impact disc assembly 250 having an impact disc 252 and impact arm or spoon 254 is illustrated. In a manner similar to the impact spoon 24, the spoon 254 is configured to increase the length of travel by the water therethrough. The increased length allows for a greater time delay before the water begins forcing the impact disc assembly 250 away from the water stream, and the greater time delay allows a greater amount of reverse drive to be exerted on the spoon 254 as the spoon 254 re-enters the water stream. This greater amount of reverse drive increases the impact energy, thus increasing the forward re-alignment of a deflector 316 and a rotation shaft 314, as will be described herein. Furthermore, the spoon 254 provides for back-impact protection.

The impact disc assembly 250 shifts in the forward rotation direction Φ as the impact spoon 254 moves away from the water stream, and shifts in the counter-rotation direction Δ as the spoon 254 moves towards and into the water stream. The impact disc 252 is substantially identical to the prior art impact disc 111, as well as to the impact disc 22 as described above, in terms of mass, size, and design, and the differences will be recognized in the following description of the impact disc 252 and the spoon 254 of the impact disc assembly 250. The impact disc assembly 250 rotates around a center of rotation 251.

The spoon 254 is defined by the impact disc 252 and a cover 256. More specifically, a portion 258 of the spoon 254 is formed on a bottom side 260 of a body 262 of the impact disc 252 (see FIG. 11), and the cover 256 (FIGS. 12 and 13) is secured to the portion 258 to define a passageway 264 through the spoon 254.

Figure 10:
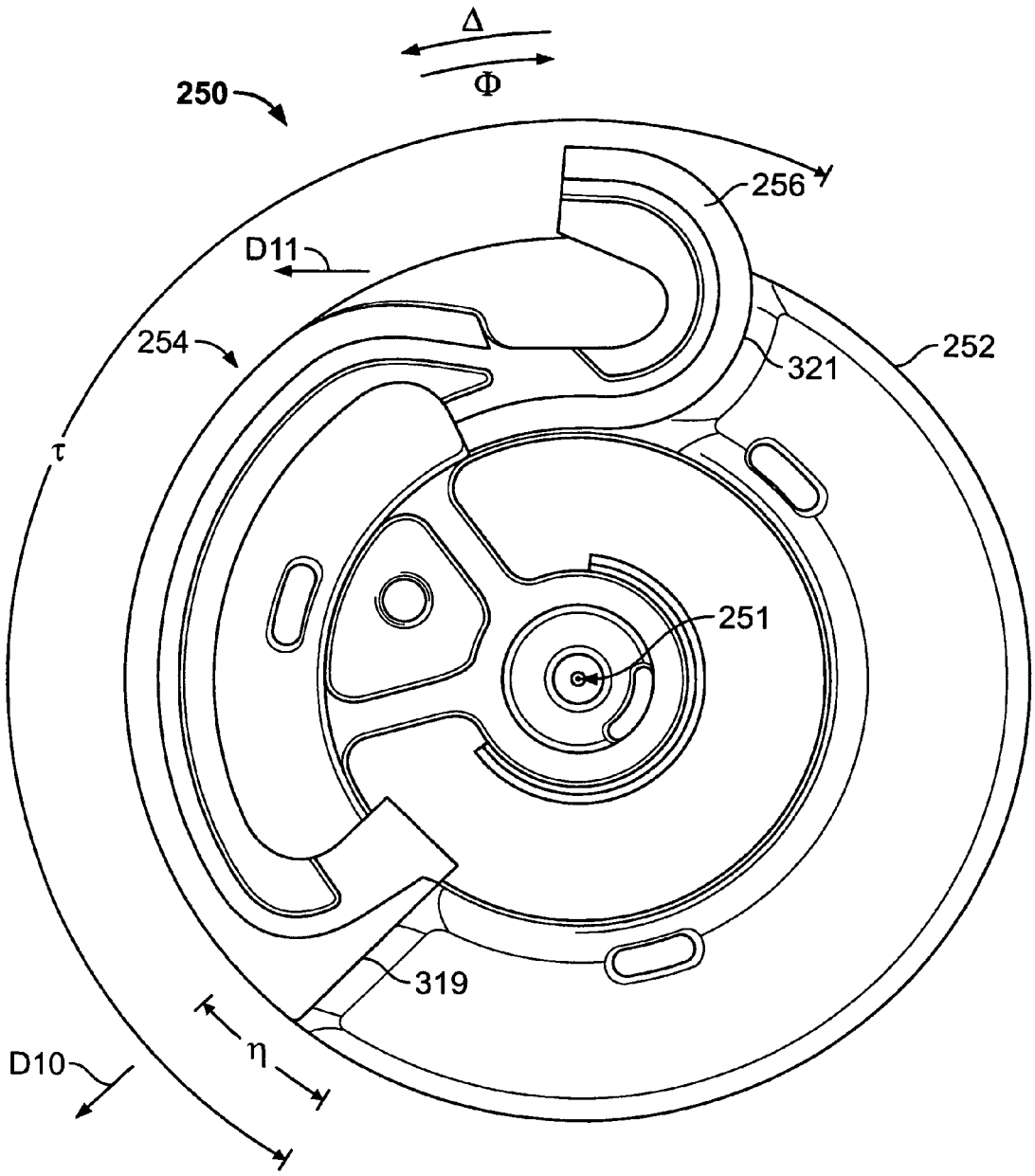
FIG. 10 is a bottom plan view of the impact disc assembly of FIG. 8 showing an impact disc and an impact arm having a cover.
Figure 11:
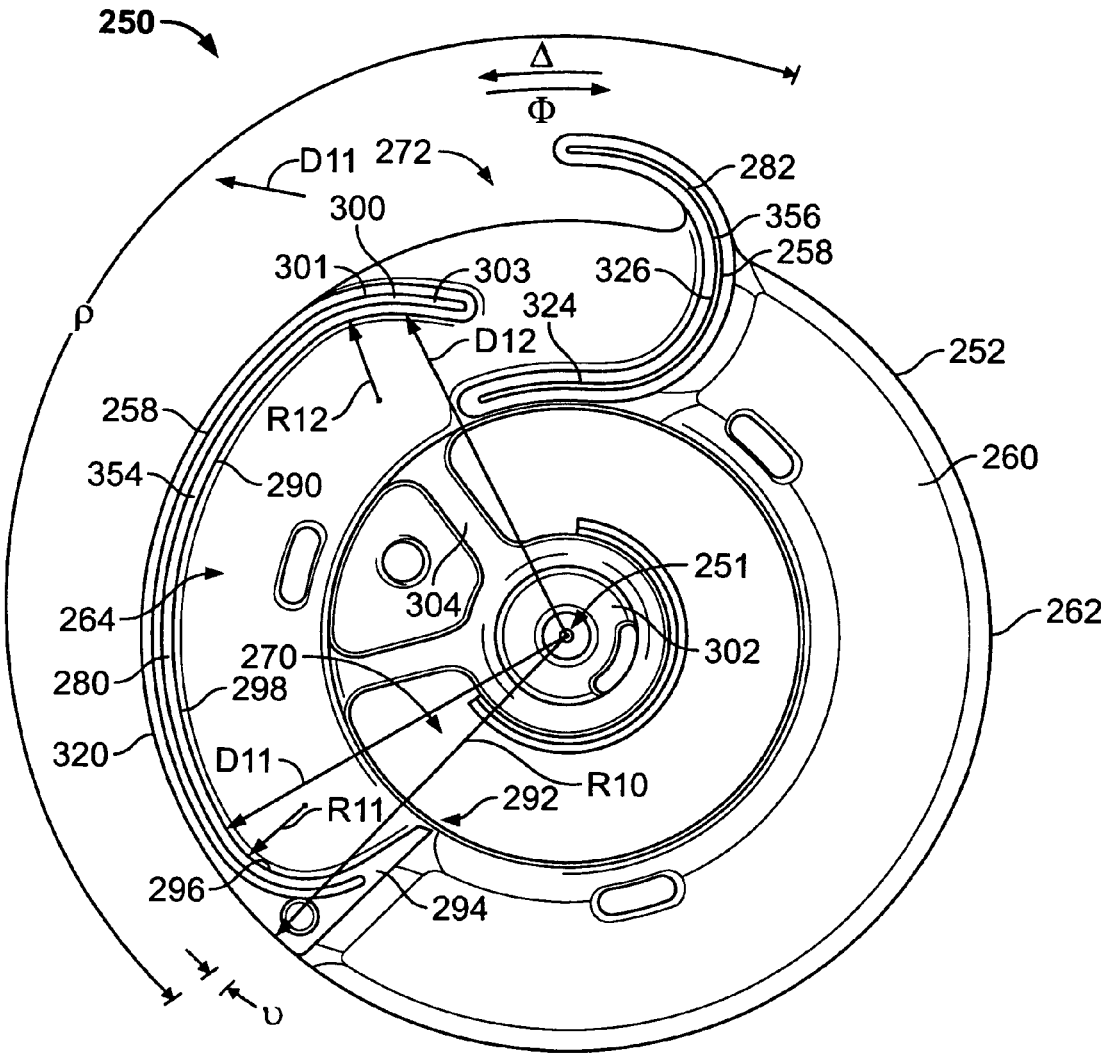
FIG. 11 is a bottom plan view of the impact disc assembly of FIG. 9 having the cover removed.
Figure 14:
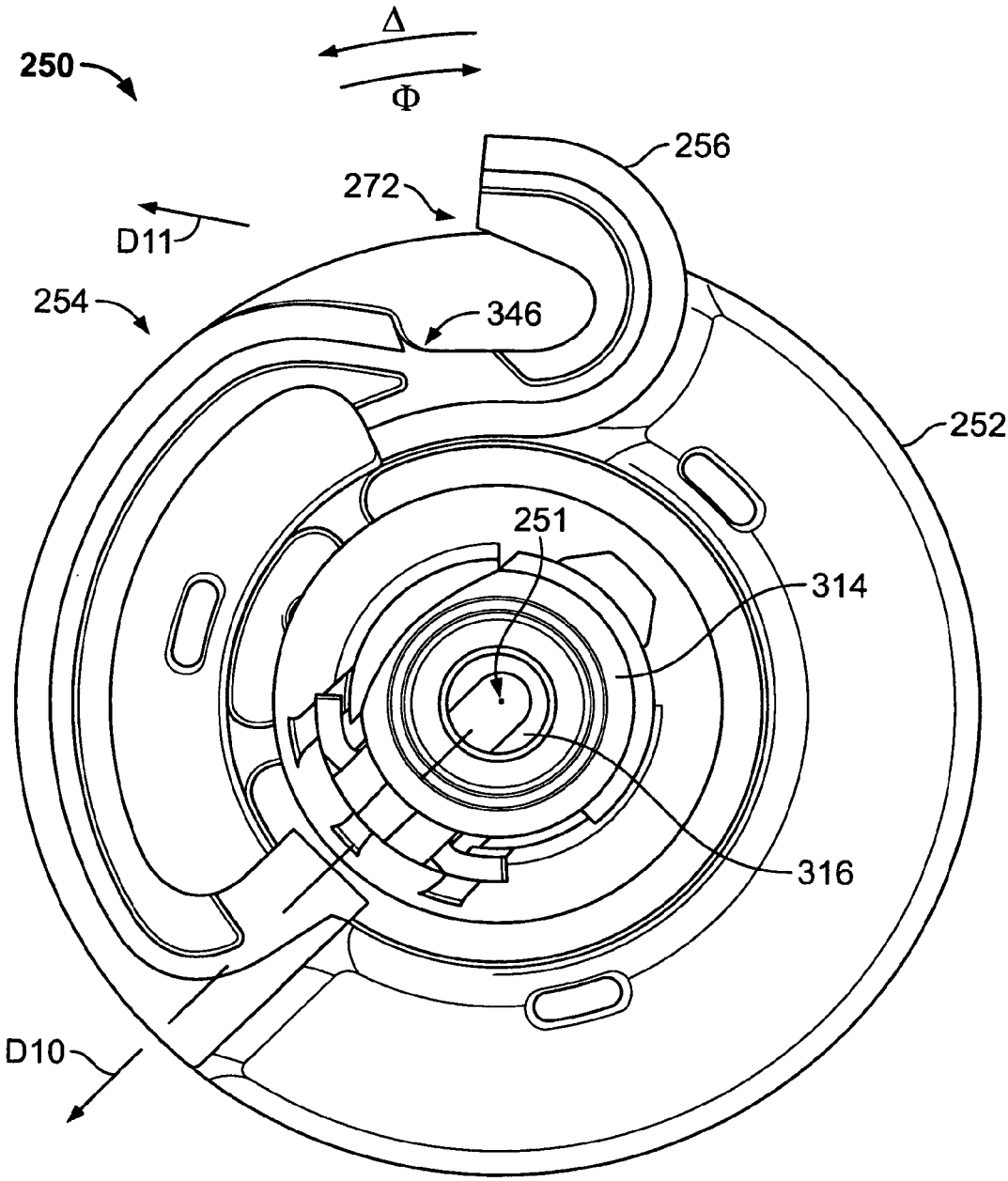
FIG. 14 is a bottom plan view of the impact disc assembly of FIG. 10 and a rotation shaft having a deflector aligned with an inlet to the impact arm.

The spoon 254 includes an inlet 270 (FIG. 8) for receiving water distributed radially from a deflector 316 in a direction D10 (FIG. 14). The water then passes through the spoon 254, providing drive energy to the impact disc assembly 250, and exits through an outlet 272 (FIG. 9) in a direction D11 (FIGS. 10 and 14). As can be seen in FIG. 14, the direction D10 for the water from the deflector 316 is non-parallel to the water stream direction D11 from the outlet 272.

Referring to FIGS. 10–13, the spoon 254 and cover 256 thereof are depicted as being somewhat S-shaped to define the S-shaped passageway 264. The portion 258 formed on the impact disc body 262 includes a first flow portion 280 and a second flow portion 282.

The water distributed from the deflector 316 enters at the inlet 270 and contacts the first flow portion 280. More specifically, the first flow portion 280 has an inner surface 290 formed on a lead-in section 292, a relatively straight inlet section 294, an arcuate elbow section 296, an arcuate perimeter section 298, and a return section 300, each of which will be discussed herein and is best viewed in FIG. 11.

The lead-in section 292 behaves in a generally similar to the lead-in section 116 of the prior art spoon 110, described above. As discussed, it is preferred that a forward leading surface 302 formed on the spoon 254 is positioned as to form a sharp point, such as shown between the leading end 202 and the outer wall inner surface 166 for the impact spoon 24 in FIG. 5, to minimize head and energy losses.

The straight inlet section 294 is formed adjacent the lead-in section surface 292. The inlet section 294 is angled into the direction of the water stream so that, as the water stream strikes the inlet section 294, a counter-rotation force in the direction Δ is imparted to the impact spoon 254 and disc 252 by the water, thus providing reverse drive to the impact disc assembly 250. The inlet section 294 is angled from a radius R10 by angle υ, preferably approximately 12 degrees.

Consequently, as the impact disc assembly 250 counter-rotates to strike a rotation shaft 314 (FIGS. 14 and 15), the spoon 254 re-enters the water stream, and the reverse drive provides additional energization to increase an impact force between the impact disc assembly 250 and the rotation shaft 314.

Figure 15:
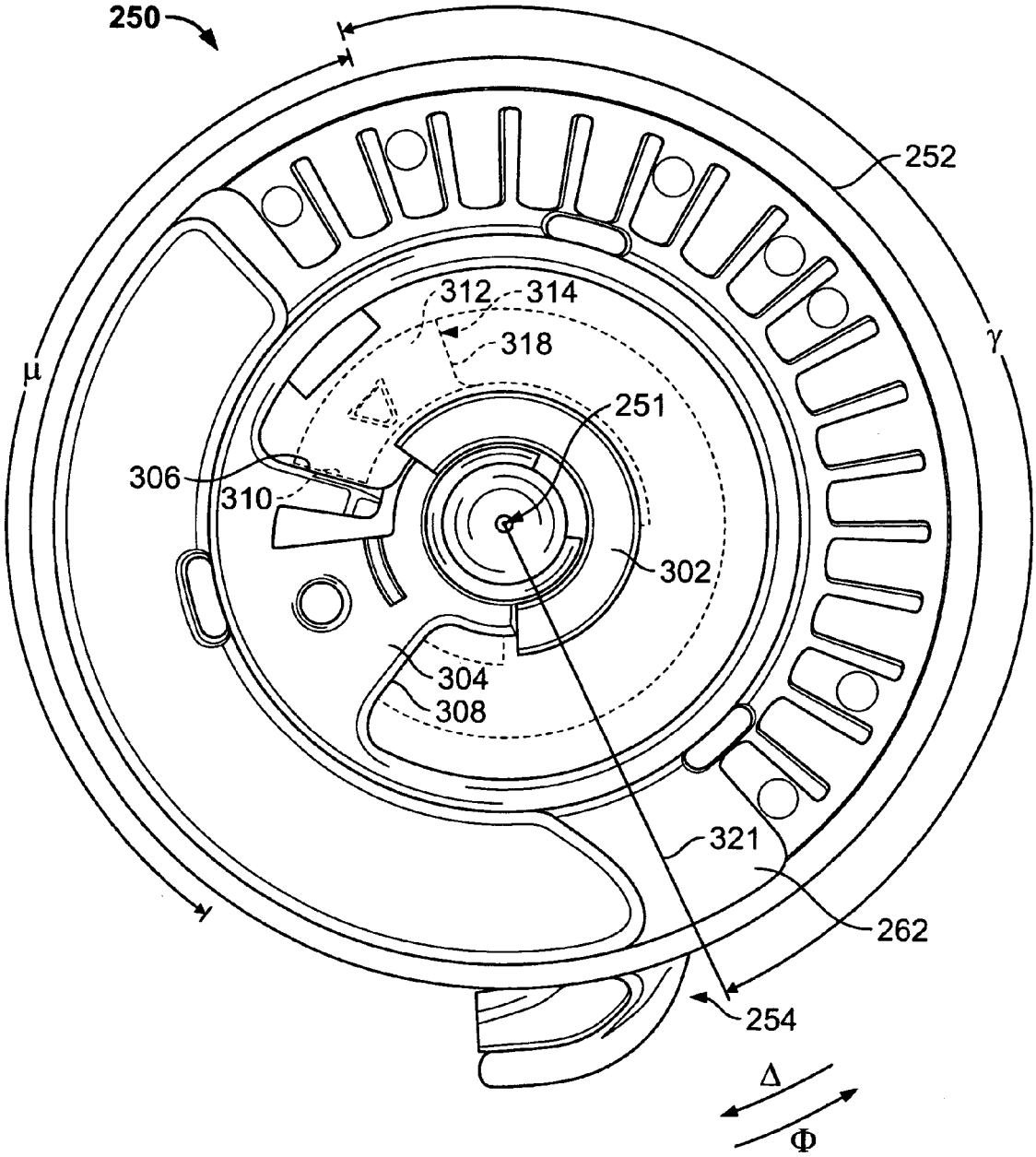
FIG. 15 is a top plan view of the impact disc assembly of FIG. 14 engaged with the rotation shaft in phantom.

The impact disc 254 includes the body 262 and a hub 302 connected to the body 262 by a bridge 304. With reference to FIG. 15, the bridge 304 has an impact surface 306 for desirably striking a reaction surface 310 formed on an upstanding portion 312 of the rotation shaft 314. The bridge 304 further has a second surface 308 that, due to the construction and design of the impact disc assembly 250, advantageously does not contact a shaft surface 318. As the impact disc assembly 250 returns to the water stream, the bridge impact surface 306 strikes the reaction surface 310 on the upstanding portion 312 to incrementally forward re-align the rotation shaft 314 in the forward direction Φ so that the water stream emitted directly to the environment from the deflector 316 is also incrementally re-aligned forwardly.

Referring now to FIG. 15, the impact disc assembly 250 is constructed to minimize the likelihood of back-impact. The spoon 254 in particular is designed so that the second flow portion 282 with the water stream restricts forward rotation and prevents back-impact. Described above, over-rotation and back-impact may result in the bridge 304 contacting the upstanding portion 312 of the rotation shaft 314 in the rotation direction, resulting in reverse re-alignment of the rotation shaft 314 and deflector 316. As noted above, bridge 304 has the bridge impact surface 306 and the second surface 308. The bridge 304 is constructed so that the surfaces 306, 308 combined with rotation shaft surfaces 310, 318 form a relatively small angular sweep μ. This serves to provide the impact disc assembly 250 with a rotational sweep available prior to any occurrence of the back-impact. It should be noted that structural limitations, such as strength, rigidity, and costs of various materials tend to require a minimal size for both the upstanding portion 312 and the bridge 304. Preferably, the angle μ is approximately 125 degrees.

Furthermore, the spoon 254 itself provides a protection against the over-rotation. As can be seen in FIGS. 10 and 15, the spoon 254 has a leading end 319 and a trailing end 321 forming an angular sweep τ. The angle τ preferably is approximately 175 degrees. Water is discharged from the deflector 316 into the inlet 270 along the direction D10. The trailing end 321 of the spoon 254 is offset from the second shaft surface 318 by an angle γ, which preferably is approximately 173 degrees. The impact disc assembly 250 would preferably need to rotate approximately 235 degrees before the bridge second surface 308 comes into contact with the second shaft surface 318, which would cause the undesirable back-impact and reverse re-alignment. The direction D10 of discharge is positioned with an angular offset η of preferably 17 degrees from the leading end 319 and the trailing end 321 needs to rotate preferably approximately 202 degrees before aligning with the water stream emitting from the deflector 316 and aligned with the direction D10 of emission. Therefore, the trailing end 321 will come into alignment with the water stream before the second surface 308 of the bridge 304 comes into contact with the second surface 318. In the event this amount of forward rotation occurs by the impact disc assembly 250, the water stream will strike the trailing end 321 to assist in slowing, stopping, and then returning the impact disc assembly 250 in the counter-rotation direction. Consequently, the impact spoon 254 itself serves to retard or prevent the back-impact from occurring.

Referring again to FIG. 11, the inlet section 294 transitions to the arcuate elbow section 296 having a radius of curvature R11, which is contoured to derive reverse-drive energy, applying force in the direction Δ, from the water stream in the same manner as the inlet section 294. The elbow section 296 curves to direct the water in a direction that preferably is generally 90 degrees from the path of the incoming water stream from the deflector 316, and to direct the water into the arcuate perimeter section 298. The radius of curvature R11 for the arcuate perimeter section 298 is preferably approximately 0.250 inches. The reverse-drive energy of the elbow section 296 increases the impact energy and, consequently, promotes a greater rotation upon impact between the impact disc assembly 250 and the rotation shaft 314, as has been discussed.

The arcuate perimeter section 298 is positioned in close proximity to an outer edge 320 of the body 262. The perimeter section 298 generally follows the outer edge 320 at a uniform distance D11 from the center of rotation 251. As the water flows along the perimeter section 298, the water exerts a force against the inner surface 290. Additionally, due to the distance D11 from the center of rotation 251, the force of the water exerts a torque, thereby imparting an amount of energy in the forward rotation direction Φ to the impact disc assembly 250. The perimeter section 298 has a preferred angular sweep of approximately 90 degrees such that its angular length preferably is approximately 1.50 inches.

Once the water has passed through the perimeter section 298, the water strikes the return section 300. The return section 300 is reverse-angled and has a curved portion 301 with a radius of curvature R12 preferably approximately 0.400 inches, and a second relatively straight portion 303 so that the length of the return section 300 is preferably approximately 0.49 inches. The water striking the return section 300 is angled inwardly and causes a rotational force to be exerted on the spoon surface 290. As can be seen, the force of the water striking the return section 300 does so at a varying distance D12 from the center of rotation 251 to produce a torque, and the distance D12 is generally equal to or greater than a varying distance D6 for the similar outlet section 122 of the prior art disc 110 (FIG. 20). The water stream then crosses the passageway 264 and transitions into the second flow portion 282.

The second flow portion 282 includes a lead wall portion 324 that transitions into an arcuate exit wall portion 326 for emitting the water stream, thus imparting a rotational force in the rotation direction Φ on the disc assembly 250. The lead wall portion 324 is preferably curved outwardly from the center 251 of the impact disc assembly 252 and has a preferred radius of curvature of approximately 0.730 inches, while the radius of curvature of the exit wall portion 326 is preferably approximately 0.278 inches. The exit wall portion 326 preferably spans generally 180 degrees so that the water stream emitted from the spoon 254 is approximately tangential to the impact disc assembly 250 and so that the water stream is able to apply the greatest force and torque in the rotation direction Φ. It should be noted that transitions between the wall sections are preferably smoothly radiused such that head loss or fluid flow pressure loss is minimized, and disruption of the flow stream is minimized.

As discussed above, the prior art spoon 110 has included angle δ between its initial point 119 of water contact and the maximum angularly displaced point 121, and the angle δ is approximately 85 degrees. In comparison, the spoon 254 has a comparable angle ρ (FIG. 11) that is preferably approximately 160 degrees.

Similar to both the impact disc assembly 20 and the prior art impact disc 111, the impact disc assembly 250 generally does not begin rotating in the rotation direction Φ until after the water stream passes from the first flow portion 280 through the channel 264 and strikes the exit wall portion 326. Utilization of the spoon inner surface 290 as described and, in particular, the perimeter section 298 allows a delay in the time before the water stream begins to strike the exit wall portion 326. The time delay allows the water stream to provide the above-described reverse drive energy to portions of the spoon 254, which further energizes the spoon 254 and impact disc assembly 250 towards the rotation shaft 314, prior to the water striking the exit wall portion 326. This maximizes the amount of impact energy and, thus, maximizes the forward re-alignment of the rotation shaft 314 and the deflector 316.

Figure 12:
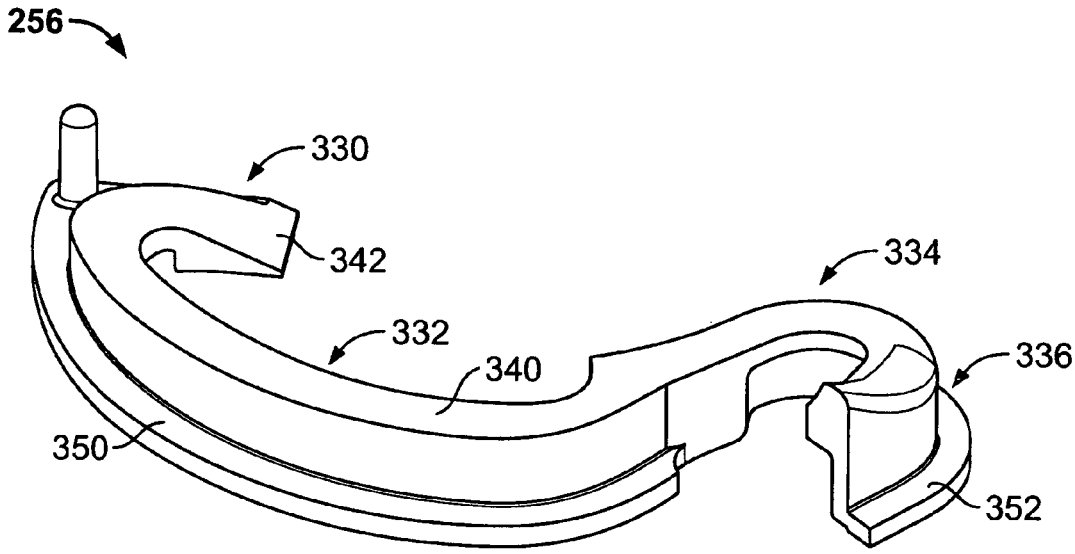
FIG. 12 is a perspective view of the cover of FIG. 10.
Figure 13:
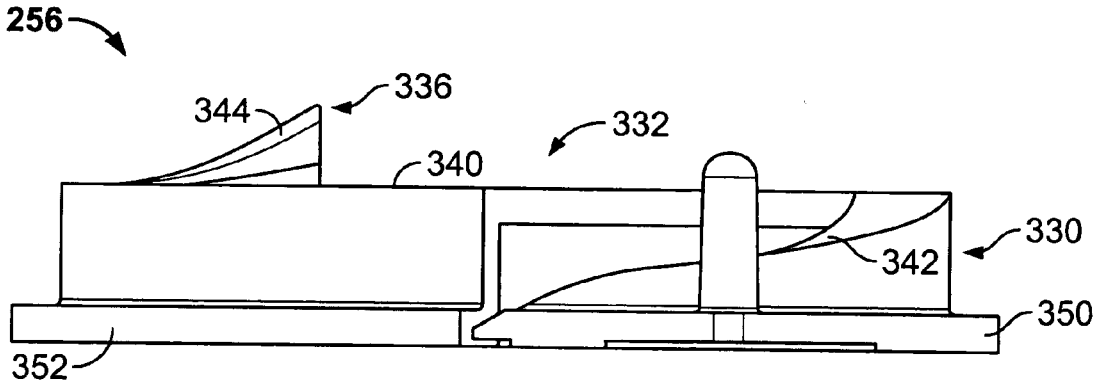
FIG. 13 is a side elevation view of the cover of FIG. 12.

Referring now to FIGS. 12 and 13, the cover 256 is illustrated in further detail. As water flows through the passageway 264, gravity acts upon the water. Accordingly, the cover 256 is provided to retain the water therein. In the present form, the spoon 254 is formed by molding the portion 258 on the body 262, and then the cover 256 is separately formed and attached to the portion 258 to jointly form the spoon 254 and to define the passageway 264. This construction for the spoon 254 and the impact disc 252 is to simplify the molding process, though other constructions are available such as a single mold construction for the spoon 254, either along with the impact disc 252 or as a separate component to be joined to the body bottom surface 260.

The cover 256 can be seen as generally Shaped having top surface 340 formed on an inlet section 330, a body section 332, a reversing section 334, and a discharge section 336, each of which is discussed herein. The top surface 340 includes a first ramp portion 342 on the inlet section 330 angling upward in the direction of entrance by the water into the spoon 254 at the inlet 270 (see FIG. 8). The first ramp portion 342 assists in collecting the water stream from the deflector 316, which may be a combination of a single laminar flow and an erratic spray, and in channeling the water stream through the passageway 264, in the same manner as the ramp surface 170 of the impact disc assembly 20. The inlet section 330 is positioned within and against the lead-in section 292, the inlet section 294, and the elbow section 296 of the first flow portion 280.

The first ramp portion 342 leads to the body section 332 which generally corresponds in shape with and is positioned within and against the perimeter section 298 of the first flow portion 280, discussed above. The top surface 340 is generally horizontal over the body section, as well as over the reversing section 334.

The reversing section 334 generally corresponds to and is positioned within and against the return section 300 and most of the second flow portion 282. In addition, the reversing section 334 includes a bridge portion 346 spanning across the passageway 264 between the first and second flow portions 280, 282, as can be seen in FIG. 14.

The top surface 340 has a second ramp portion 344 formed on the discharge section 336 and angling upwardly. The discharge section 336 is also positioned within and against the second flow portion 282 proximate to the outlet 272. The upward angle of the second ramp portion 344 provides an upward trajectory for the water stream emitted from the spoon 254.

As the majority of the path through the passageway 264 for the water flowing through the spoon 254 is generally horizontal, distribution uniformity of the water stream is improved. The second ramp surface 344 provides a significant throw distance for the water exiting the spoon 254, contributing to the ability of this portion of the water stream to be distributed for watering purposes and not simply dispersed unduly close to the sprinkler 10. It should be noted, however, that the horizontal movement is not necessary for the operation of the impact disc assembly 250.

The cover 256 further includes first and second walls 350, 352 for securement with the first and second flow portions 280, 282 of the spoon 254. More specifically, the first wall 350 is positioned on a top edge 354 of the first flow portion 280, while the second wall 352 is positioned on a top edge 356 of the second flow portion 282. The cover 256 generally seals with the first and second flow portions 280, 282 to restrict or prevent water from flowing between the cover 256 and the top edges 354, 356.

Figure 21:
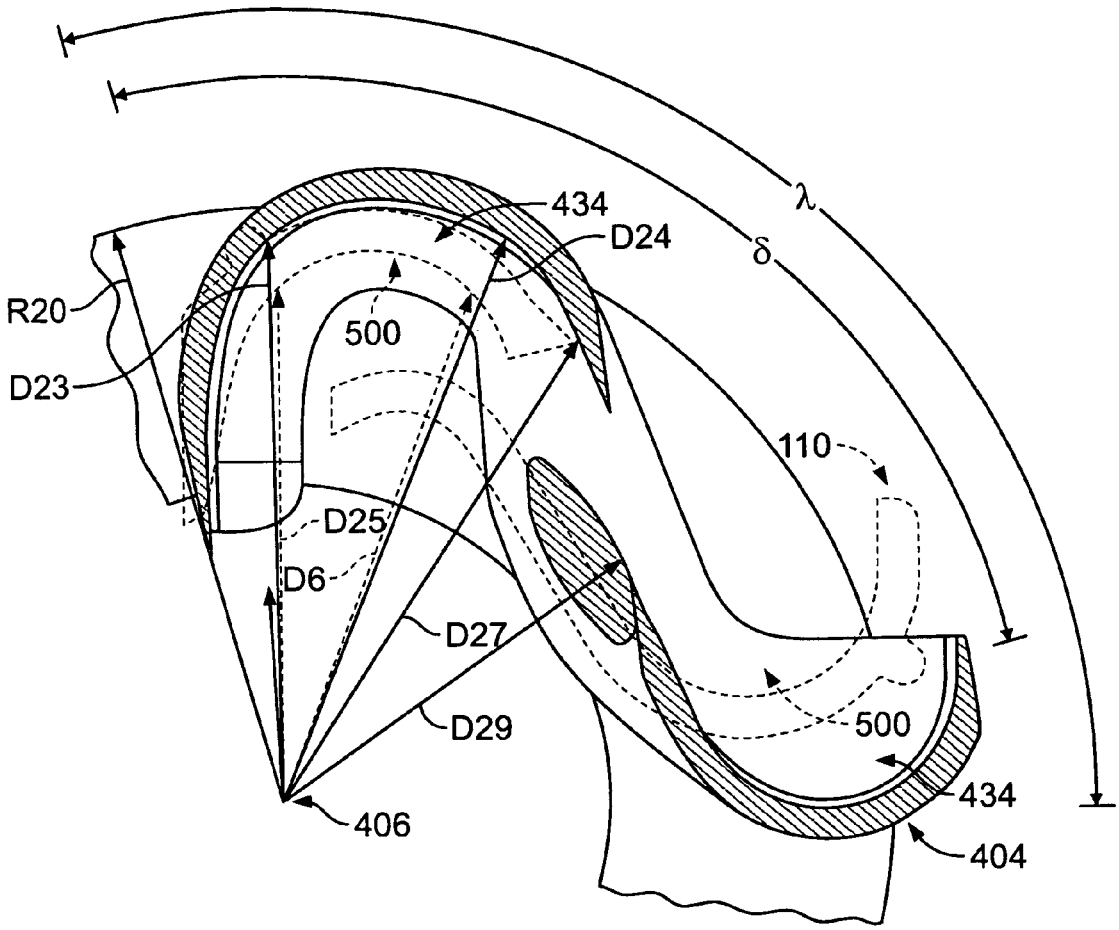
FIG. 21 is a cross-sectional view of the impact arm of FIG. 19 and a cross-sectional view of the prior art impact arm of FIG. 20 in phantom.

Referring now to FIGS. 16–19, a further form of an impact disc assembly 400 having an impact disc 402 and impact spoon 404 is illustrated. With further reference to FIG. 21, it can be seen that the spoon 404 has a longer length than the prior art spoon 110. The longer length provides a greater time delay from when the spoon 404 re-enters the water stream to the time the water stream causes the spoon 404 to begin rotating away from and out of the water stream. As described for the spoons 24 and 254, this time delay allows the water stream to provide reverse drive energy to portions of the spoon 404, thereby providing additional energization to increase an impact between the impact disc assembly 400 and a rotation shaft 520. The longer length also enables the spoon 404 to receive a greater amount of water prior to shifting from the water stream, this greater amount of water energizing the impact disc assembly 400 over the additional length. The spoon 404 further includes portions positioned at distances from the center of rotation that are greater than comparable portions of the prior art spoon 110 so that the torque arm produced by water acting on those portions to rotate the impact disc assembly around a center of rotation 406 is greater for the spoon 404 than for the prior art spoon 110.

The impact disc 402 includes a body 410 having a bottom surface 412 on which the spoon 404 may be secured or formed. The impact disc 402 is rotatably supported by a hub 414 connected to the body 410 by a bridge 416. The impact disc 402 is generally substantially identical to the above-discussed impact discs in terms of size, mass, and design. As such, the bridge 416 includes an impact surface 418 for a desirable impact with an upstanding arm formed on a rotation shaft 520 (FIG. 16) for forward re-alignment of a deflector secured with the rotation shaft so that a water stream emitted from the deflector is re-aligned to distribute water therefrom in an angularly re-aligned direction (see above). The bridge 416 further includes a second surface 420 that, due to the design of the impact disc assembly 400, advantageously does not impact with the rotation shaft to cause undesirable reverse re-alignment of the deflector and the water stream distributing water therefrom.

Figure 19:
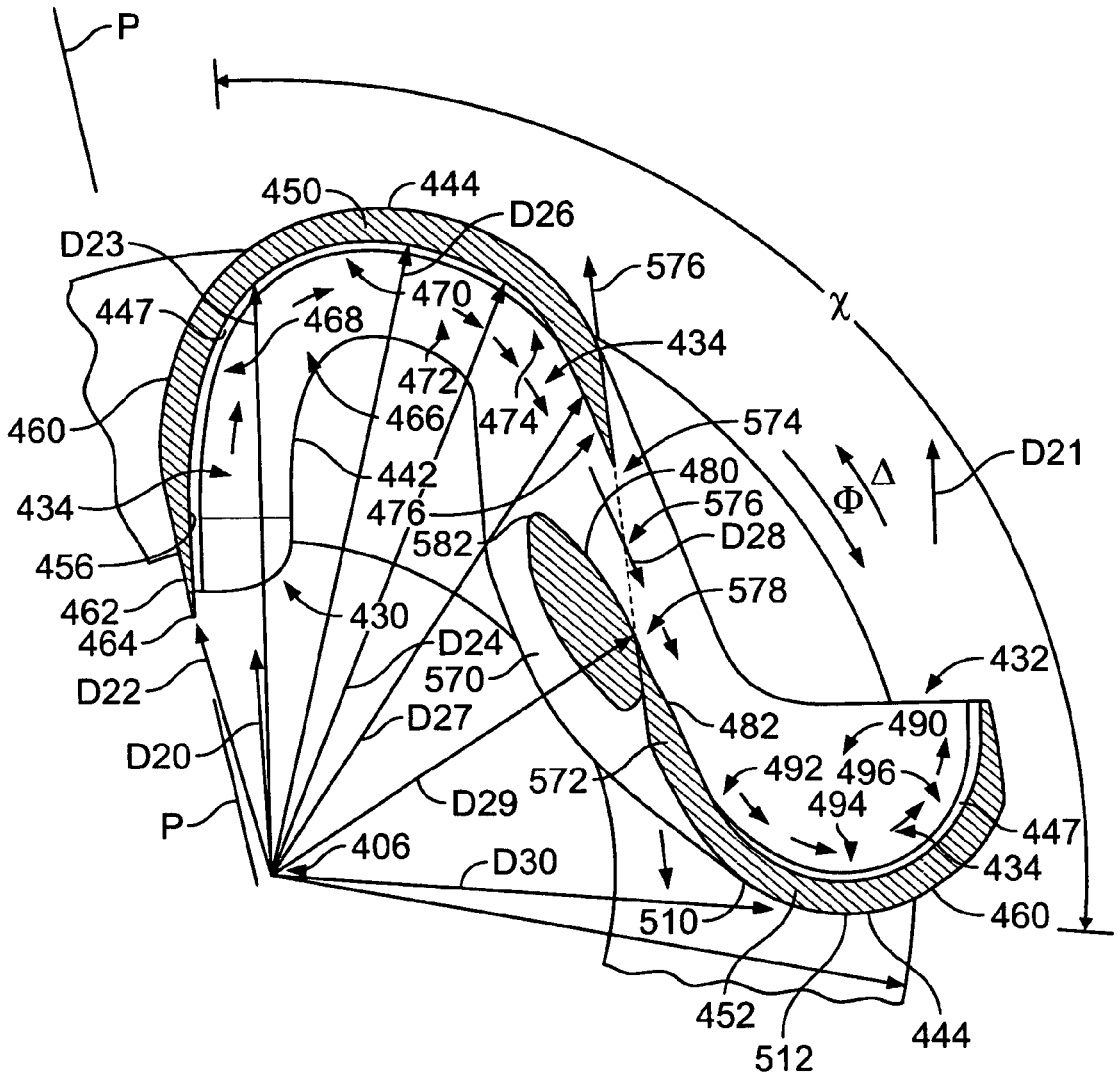
FIG. 19 is a fragmentary bottom plan view of the impact disc assembly of FIG. 16 showing the impact arm in cross-section.

The impact spoon 404 includes an inlet 430 for receiving a water stream from the deflector, and an outlet 432 for emitting the water after passing through the spoon 404. The impact spoon 404 provides a path 434 between the inlet 430 and outlet 432 along which the water flows through the spoon 404 imparting energy to the spoon 404 and, thus, to the impact disc assembly 400. As best seen in FIG. 19, the path 434 is generally Shaped, the water being received at the inlet 430 in a direction D20 and being emitted from the outlet 432 in a direction D21.

The spoon 404 includes a bottom wall 440, a top wall 442, and a director wall 444. The bottom and top walls 440, 442 are generally parallel with each other. The bottom wall 440 includes an entrance ramp 446 for directing and channeling the water stream received therein through the spoon path 434.

The director wall 444 includes a first flow portion 450 and a second flow portion 452. The first flow portion 450 includes an inlet section 456 which is struck by water as the spoon 404 is returning to the water stream so that the water stream is directed along a direction D22, or in a direction located between the direction D22 and the direction D20 (FIG. 19). The director wall 444 has an outside surface 460 which, at the inlet 430, includes a beveled portion 462 forming a sharp or small radius point 464 with the inlet section 456. Consequently, the loss of both forward and reverse drive that is experienced by the prior art spoon 110 having the surface 124, discussed above, is significantly reduced as the point 464 passes through the water stream from the deflector. It should be noted that the direction D22 is aligned with the point 464 such that any shifting of the impact disc assembly 400 in the forward rotation direction Φ allows the water stream to pass by the inlet section 456. It should also be noted that the beveled portion 462 is generally oriented in a vertically-aligned plane P (FIG. 19) that is non-parallel to water stream direction D22 when the water is impacting at the point 456 so that any water that passes by the point 456 does not contact the beveled portion 462.

The water flows from the inlet section 456 to an arcuate flow section 466 of the first flow portion 450. Water impacting the inlet section 456 and a portion of the arcuate flow section 466 imparts counter-rotation force and reverse drive energy to assist in directing the impact disc assembly 400 into the rotation shaft as the spoon 404 returns into the water stream. The arcuate flow section 466 has a varying degree of curvature so that discrete portions therealong have different radii of curvature. Thus, the arcuate flow section 466 has a first arcuate section 468 which tends to curve slightly, a second arcuate section 470 providing a greater curvature, a third arcuate section 472 with only a slight curvature, and a fourth arcuate section 474 with a greater curvature.

As the water passes through the first arcuate section 468, the amount of work done by the water thereagainst is lower in comparison to the greater curve of the second and fourth arcuate sections 470, 474. By design, the second and fourth arcuate sections 470, 474 are positioned at respective varying distances D23, D24 from the center of rotation 406 so that the water acting on these sections 470, 474 produces a torque in proportion to these distances D23, D24. As can be seen in FIG. 21, the distances D23 and D24 are greater than comparable distances D25 and D6 for the prior art spoon 110. Accordingly, the torque arm for water passing through the second and fourth arcuate sections 470, 474 is greater than for the prior art spoon 110. Additionally, the third arcuate section 472 is positioned at a distance D26 from the center of rotation 406 so that the water acting thereupon also has a large torque arm. The distance D26 is greater than a radius R20 for the impact disc body 410

After passing through the fourth arcuate section 474, the water flows against an outlet section 476 that is relatively straight and is positioned a varying distance D27 from the center of rotation 406. As can be seen in FIG. 21, the distance D27 is greater than any distance along the first flow portion 112 of the prior art spoon 110. Accordingly, the torque arm for water passing against the outlet section 476 is greater than that of the prior art spoon 110.

The water passes from acting on an inwardly directed surface on the first flow portion 450 to acting on an outwardly directed surface formed on the second flow portion 452. Water flows from the first flow portion 450 to the second flow portion 452 generally along a direction D28. As this flow is not necessarily a laminar flow, instead including erratic spray molecules, the second flow portion 452 has an entrance portion 480 angled to collect and channel the water from the first flow portion 450. The entrance portion 480 transitions smoothly to a relatively straight section 482. The entrance portion and section 482 are positioned at a distance D29 from the center of rotation 406. The distance D29 varies so as to increase so that the section 482 angles outward as the water flows therealong. Accordingly, water flowing therealong produces a torque against the spoon 404, and, as can be seen in FIG. 21, this distance D29 is greater than any comparable distance along the second flow portion 114 of the prior art spoon 110.

The second flow portion 452 further includes an arcuate section 490 shaped in a manner similar to the arcuate flow section 466 of the first flow portion 450. That is, the arcuate section 490 includes first and third curved sections 492, 496 being more sharply curved than a second curved section 494. As the second flow portion 452 is generally positioned at a distance equal to or greater than the second flow portion 114 of the prior art spoon 110, the torque created by the water through the second flow portion 452 is greater.

Referring to FIG. 21 in specific, the path 434 that the water travels through the spoon 404 can be seen as being Longer than a path 500 for the prior art spoon 110. This provides the greater time delay before the impact disc assembly 400 begins shifting from the water stream, and allows a greater amount of water to be received by the spoon 404 than by the prior art spoon 110, each noted above. More specifically, the first flow portion 450 is shaped so that a preferred average travel distance therethrough is approximately 1.93 inches, the second flow portion 452 is shaped so that a preferred average travel distance therethrough is approximately 1.05 inches, and the preferred total water travel distance through the spoon 404 is approximately 2.98 inches. In comparison, the prior art spoon 110 has a total water travel distance of approximately 2.41 inches. As previously stated, the prior art spoon 110 has an included angle δ between its leading or initial point 119 of water contact on the first flow portion 112 and the point 121 of its maximum angular distance on the second flow portion 114, and the preferred angle δ is approximately 85 degrees. To compare, the spoon 404 has a comparable angle λ (FIG. 21), approximately 100 degrees.

The additional length of the spoon 404 also provides for back-impact restriction or prevention. More specifically, the second flow portion 452 has an outer surface 510 with a leading point 512 located at an angle χ from the direction of the water stream D20. Prior to the second impact surface 420 coming into contact with the rotation shaft, the impact disc assembly 400 will rotate so that the leading point 512 interferes with the water stream. The preferred angle χ is approximately 100 degrees, and the preferred amount of rotation required for the leading point 512 to interfere with the water stream is preferably approximately 260 degrees.

Figure 16:
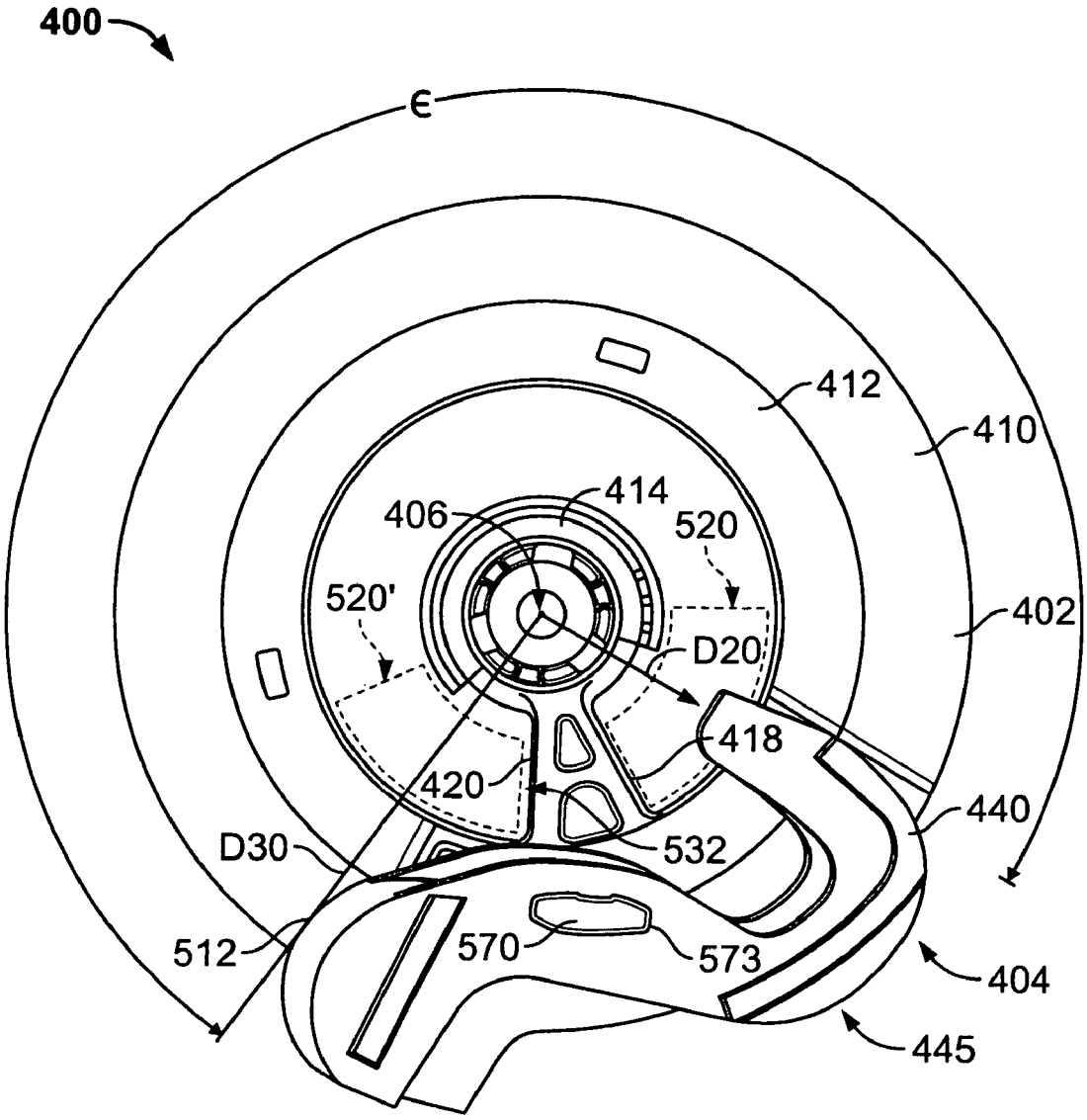
FIG. 16 is a bottom plan view of an additional alternative form of an impact disc assembly including an impact disc and an impact arm.

With reference to FIG. 16, it can be seen that the water stream is emitted in direction D20 when the water stream enters the spoon 404, and the impact disc assembly 400 position is immediately after an impact with a rotation shaft 520 and prior to the impact disc assembly 400 being energized and shifted by the water stream. In this position, the first impact surface 418 of the bridge 416 is positioned against or close to the rotation shaft 520. Once the impact disc assembly 400 is energized, it may rotate an angle ϵ, at which point the leading point 512 will interfere with the water stream which is shown as being in the direction D30. As noted previously, the directions D30 and D20 have an included angle χ. Were the impact disc assembly 400 to rotate the entire angle ϵ, the rotation shaft is in the position represented by rotation shaft 520'. As can be seen, there is a gap 532 between the second impact surface 420 and the rotation shaft 520'. Thus the water stream impacting the spoon 404 at the leading point 512 restricts or prevents continued rotation for the impact disc assembly 400, and the second impact surface 420 is restricted or prevented from contacting the rotation shaft 520'.

Figure 17:
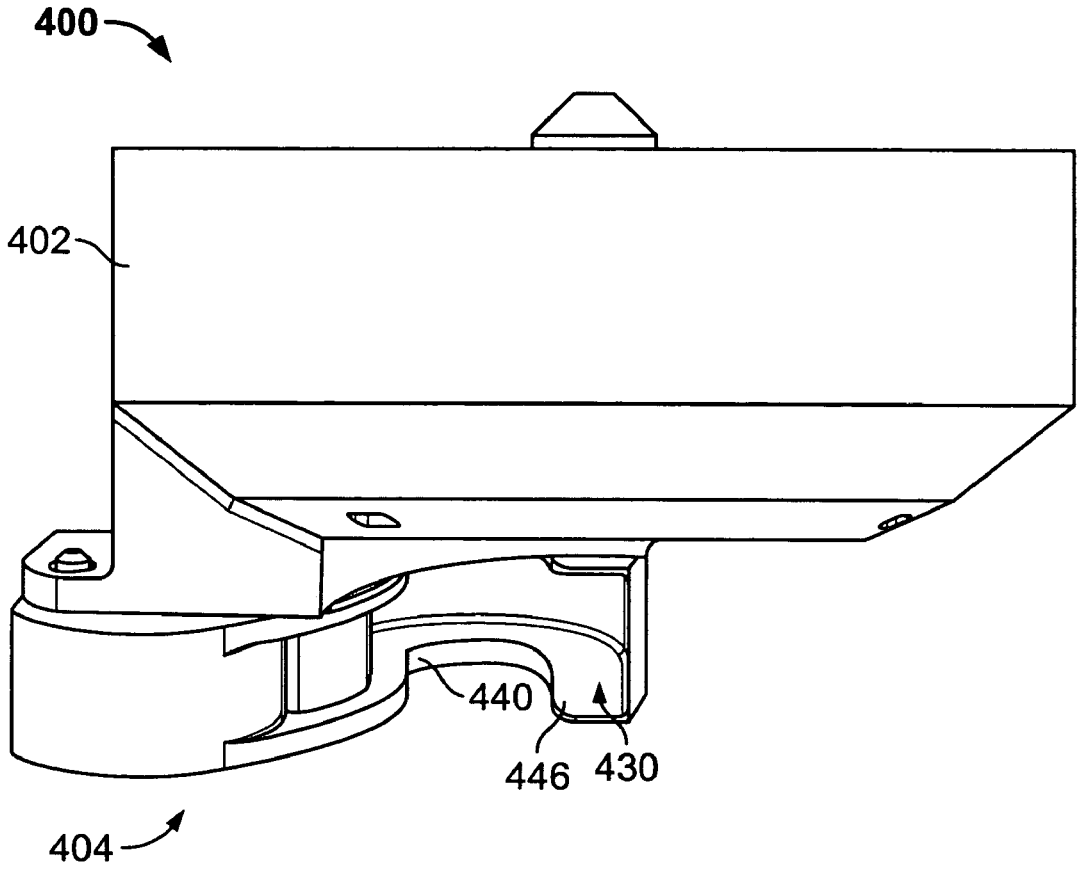
FIG. 17 is a side elevation view of the impact disc assembly of FIG. 16.
Figure 18:
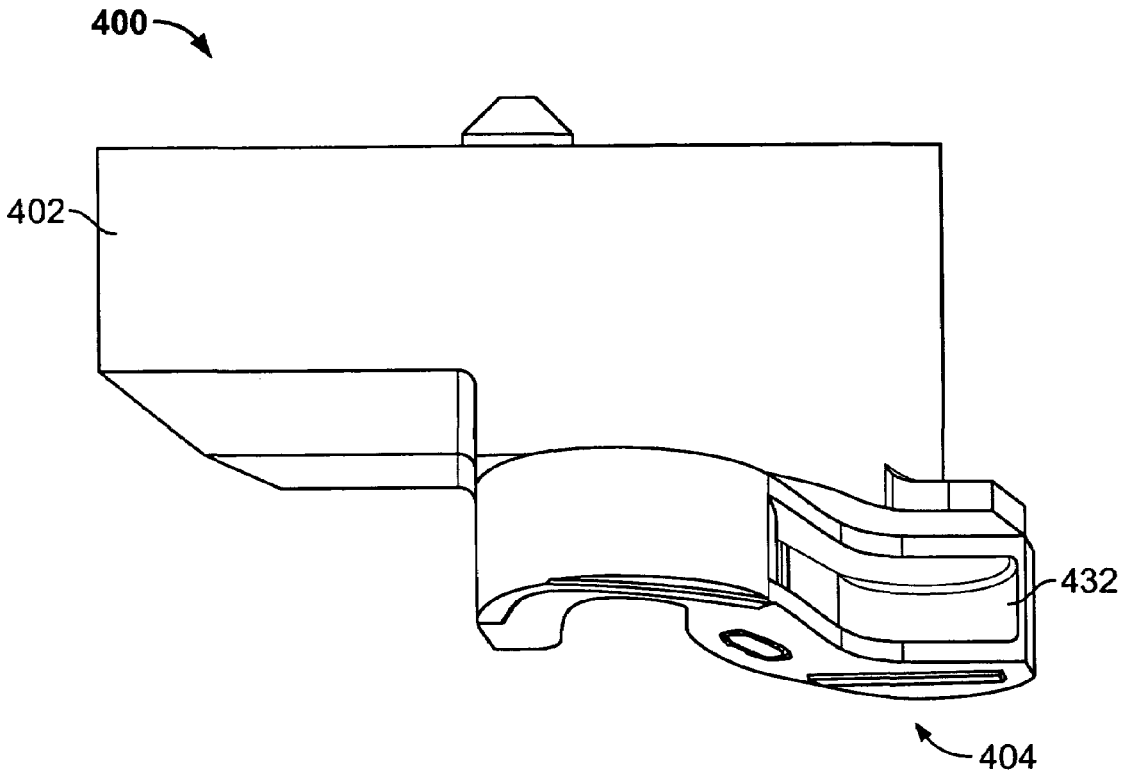
FIG. 18 is a side elevation view of the impact disc assembly of FIG. 16.

As can be seen in FIGS. 17 and 18, the spoon 404 is angled from a horizontal plane. This angle allows the spoon 404 to have a slightly longer flow path 434 within the angular sweep required for the spoon 404 in the horizontal plane. Accordingly, the initial portion of the first flow portion 450 including the inlet section 456, the first arcuate section 468, and a portion of the second and third arcuate sections 470, 472 are is angled upward. The third arcuate section 472 curves sufficiently so that it is re-directed somewhat inwardly so that a portion is also angled downwardly as the water travels therethrough. The water path from the third arcuate section 472 flows through a portion of the second curved section 494 of the second flow portion 452, at which point the water path curves sufficiently to be directed somewhat outwardly and angles upward. This final angle upward, at the outlet 432, provides the water with an upward trajectory so that the water is not merely deposited from the outlet 432 at the base or within a relatively close proximity to the sprinkler.

The construction of the spoon 404 provides an additional benefit over then prior art spoon 110. With reference to FIG. 20, the prior art spoon 110 is formed by securing a molded piece 117, including the first and second flow portions 112 and 114, as well as a bottom wall 113 shown in phantom and spanning the area bound by the first and second flow portions 112 and 114. The molded piece 117, including the first and second flow portions 112 and 114 and the bottom wall 113, is formed and then secured to the bottom surface of the impact disc 111. Accordingly, its size is generally limited to the size of the impact disc 111. Each of the other spoons described herein, are constructed to have a larger size than the impact disc to which they are secured.

To provide for this larger size, the impact spoons described herein include top and bottom walls with the flow path for water through the spoon between the walls. However, it is desirable to minimize the number of components for the spoons, and to maximize the ease of construction of the spoon on their respective impact discs.

With particular reference to the impact spoon 404 in FIG. 19, the second flow portion 452 of the director wall 444 is formed by an insert 570 and a wall portion 572. The bottom wall 440, top wall 442, first flow portion 450, and wall portion 572 are formed as a single molded piece 445 (FIG. 16) that may be secured to, or molded as a single component with, the impact disc 402. The insert 570 may then be received through an opening 573 (FIG. 16) formed in the bottom wall 440. The first flow portion 450 generally terminates at an edge 574 along a line 576, and the line 576 is generally coincident with an origin or first edge 578 of the wall portion 572. With this construction, the single piece 445 is generally a single molded item securable to the impact disc 402, with the insert 570 being a separate molded piece that may be joined with the single piece 445 either before or after the single piece 445 is joined with the impact disc 402. It should be noted that the insert 570 may have a step (not shown) or other structure so that, once the spoon 404 is secured to the impact disc 402, the insert 570 does not come out of the opening 573.

This construction also benefits the water flow characteristics. The insert 570 has a forward edge 582. As can be seen in FIG. 19, the water flowing from the first flow portion 450 to the second flow portion 452 is generally directed along the direction D28. The forward edge 582 is positioned sufficiently upstream to be positioned across from the first flow portion edge 574, that is, lateral with respect to the flow direction D28. This reduces or eliminates any back-spray that may result from erratically flowing water, thus reducing wasted energy, head loss, or negative pressure on the flow stream.

In addition, as the construction of the single piece 445 for the spoon 404 reduces wasted energy, head loss, and negative pressure. For the prior art spoon 110, it was noted that the single piece 117 is secured to the impact disc 111. Molded parts often have burrs or flashing formed on their edges, and the joining of plastic components often produces weld flashing. When the edges of the single piece 117 are joined with the impact disc 111, flashing can produce incongruities that disturb the flow of water across the joints.

The spoon 404 and its single piece 445 eliminate or reduce these incongruities. Due to the single piece molding, the single piece 445 does not generally have mold edges or weld seams that are in within the flow path 434 of the water. The bottom and top walls 440, 442 form smoothly contoured transition portions 447 with the first and second flow portions 450, 452, as can be seen in FIG. 19 between the top wall 442 and flow portions 450,452. Accordingly, the detrimental flow characteristics of the prior art spoon 110 are reduced or eliminated.

Figure 22:
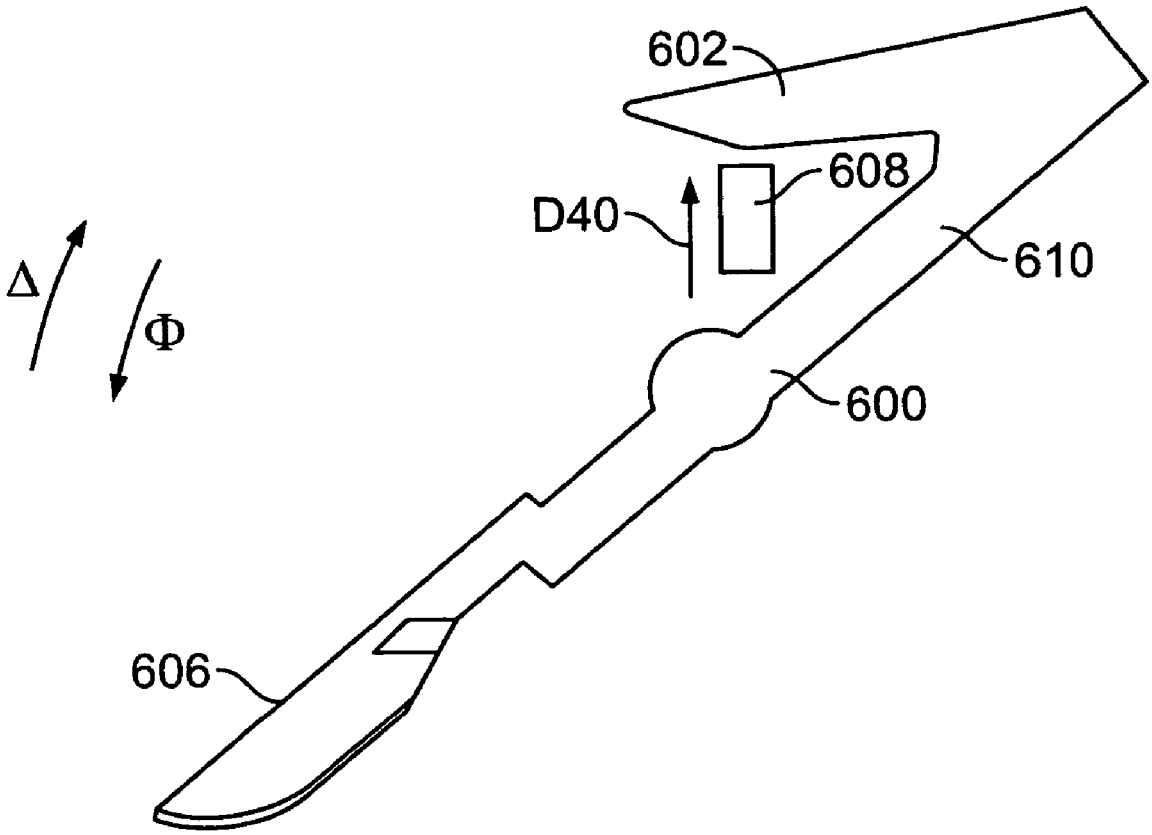
FIG. 22 is a top plan view of an impact arm of an alternative form of impact sprinkler.

It should be noted that the back-impact prevention features noted herein are applicable to a wide variety of impact sprinklers. As can be seen in FIG. 22, a sprinkler impact arm 600 may incorporate an angled drive plane 602 with the arm 600 such that, beyond a certain rotation, the drive plane 602 interferes with a water stream emitted in a direction D40 from a water emission member, which may be a deflector or a nozzle or both, for instance. At this rotation amount, the water stream slows the movement of the arm 600 in order to reduce or eliminate back impact. Again, this interference assists the bias member or spring with returning the impact assembly (or arm 600) towards and to a position for impacting a portion on which the water emission member is located.

More specifically, the water stream may strike a first portion 606 of the arm 600 such that the arm 600 rotates in the forward rotation direction Φ. When the arm 600 returns, it will strike a stop 608, thereby causing a short rotation of the stop 608 which is connected to the water emission member. In order to prevent a second portion 610 of the arm 600 from contacting the stop 608 and providing a reverse re-alignment to the water emission member, the drive plane 602 is positioned on the arm 600 such that a predetermined amount of rotation causes the drive plane 602 to interfere with the water stream. Thus, the water stream slows and assists in returning the arm 600 towards the stop 608 in the counter-rotation direction Δ.

While the invention has been described with respect to specific examples, including presently preferred modes of carrying out the invention, those skilled in the art will appreciate that there are numerous variations and permutations of the above described apparatuses and method that fall within the spirit and scope of the invention as set forth in the appended claims.

What is claimed is:

1. A rotary sprinkler comprising:

a housing having an inlet for receiving water flow from a water source;

a nozzle in communication with the inlet for producing a water stream from the water flow;

a shaft assembly rotatably supported by the housing and including a distribution outlet for directing and discharging the water stream from the sprinkler in a first distribution direction;

a drive assembly for rotating the shaft assembly in response to receiving a portion of the water stream for a period of time to relocate the distribution outlet to discharge water from the distribution outlet in a second distribution direction, the drive assembly including an impact arm having an outer surface and a water-receiving surface defining an arm inlet, an arm outlet, a passageway between the arm inlet and the arm outlet, and a discharge portion for discharging water from the arm outlet, wherein the water stream imparts to the water-receiving surface a first force in a first direction to move the drive assembly away from the water stream and a second force to move the drive assembly toward the shaft assembly to relocate the distribution outlet, the water-receiving surface being configured so that during the period of time the second force is greater than the first force generally at least until relocating the distribution outlet.

2. The rotary sprinkler of claim 1 wherein the water stream from the distribution outlet is discharged directly to the environment prior to and subsequent to the period of time, and the water stream from the distribution outlet is received by the impact arm at the arm inlet during the period of time, the water received by the impact arm is discharged in a stream by the discharge portion from the arm outlet, and the first force on the discharge portion forces the drive assembly to rotatably shift away from the water stream from the distribution outlet the after the distribution outlet is relocated.

3. The rotary sprinkler of claim 2 wherein the water-receiving surface is a continuous surface between the arm inlet and the discharge portion.

4. The rotary sprinkler of claim 3 wherein the continuous surface includes at least a curved portion directing water flowing through the spoon through in a first flow direction generally along a first plane, and the discharge portion includes a discharge surface directing water in a second flow direction generally along a second plane.

5. The rotary sprinkler of claim 1 wherein the impact arm is generally S-shaped.

6. The rotary sprinkler of claim 1 wherein the water-receiving surface includes a first curved portion with a generally constant radial distance from a center of rotation of the drive assembly.

7. The rotary sprinkler of claim 6 wherein the first curved portion is continuous with a discharge surface of the discharge portion.

8. The rotary sprinkler of claim 6 wherein the water-receiving surface includes a second curved portion continuous with a discharge surface of the discharge portion, and the first and second curved portions are positioned on respective sides of the passageway.

9. The rotary sprinkler of claim 1 wherein impact arm includes an impact wall including the water-receiving surface, art upper wall, and a lower wall, the water-receiving surface including first and second water-receiving portions having respective first and second curved portions positioned on respective sides of the passageway, the second curved portion is continuous with a discharge surface of the discharge portion, and the impact wall, upper wall, and lower wall are formed integral.

10. The rotary sprinkler of claim 9 wherein the drive assembly includes an impact disc having a mass and a radius from a center of rotation of the drive assembly, and the impact wall, upper wall, and lower wall of the impact arm is formed integral with the drive assembly.

11. The rotary sprinlder of claim 10 wherein the impact arm includes an insert spanning between the upper and lower walls, the insert having an insert water-receiving surface continuous with the second water-receiving portion of the impact arm.

12. The rotary sprinkler of claim 11 wherein at least a portion of the insert water-receiving surface and at least a portion of the first water-receiving portion are positioned along a line transverse to a direction of water flow through a portion of the passageway.

13. The rotary sprinkler of claim 1 wherein the water flow from the water source has a pressure in the range of 20–60 psi.

14. A rotary sprinkler comprising:

a housing having an inlet for receiving water flow from a water source;

a nozzle in communication with the inlet for producing a water stream with a flow rate;

a shaft assembly rotatably supported by the housing and including a distribution outlet for directing and discharging the water stream from the sprinkler in a first distribution direction;

a drive assembly for rotating the shaft assembly in response to receiving a portion of the water stream during intermittent energization time periods to reposition the distribution outlet to discharge water from the distribution outlet in a second distribution direction, the drive assembly including:

an impact disc having a mass and a radius from a center of rotation thereof, and having a first surface for impacting with a portion of the shaft assembly to rotate the shaft assembly, and having a second surface positioned a rotational angle from the first surface, and an impact arm having a water-receiving surface for deriving rotational force in a first direction from the water stream to force the drive assembly away from the water stream from the distribution outlet, and having an outer surface configured to interfere with the water stream from the distribution outlet by rotation of the impact disc in the first direction by an interference angle, wherein the rotational angle is greater than the interference angle.

15. The rotary sprinkler of claim 14 wherein the impact disc includes:

a hub for rotatably supporting the drive assembly at the center of rotation, and a bridge connecting the hub with the impact disc and having the first surface for impacting with a portion of the shaft assembly formed thereon, and having the second surface positioned a rotational angle from the first surface formed thereon.

16. The rotary sprinkler of claim 15 wherein the impact disc, the hub, the bridge, and the impact arm rotate as a single unit.

17. An impact sprinkler comprising:

a body;

a nozzle in communication with a water source for receiving water and for producing a water stream with a flow rate;

a shaft assembly rotatably supported by the housing and including a distribution outlet for directing and discharging the water stream from the sprinkler in a first distribution direction;

a drive assembly for rotating the shaft assembly in response to receiving a portion of the water stream during intermittent energization time periods to reposition the distribution outlet to discharge water from the distribution outlet in a second distribution direction, the drive assembly including:

a first surface for impacting with a portion of the shaft assembly to rotate the shaft assembly, a second surface positioned a rotational angle from the first surface, a water-receiving surface for deriving rotational force in a first direction from the water stream to force the drive assembly away from the water stream from the distribution outlet, and an outer surface configured to interfere with the water stream from distribution outlet by rotation of the drive assembly in the first direction by an interference angle, wherein the rotational angle is greater than the interference angle.

18. A rotary sprinkler comprising:

a housing having an inlet for receiving water flow from a water source;

a nozzle in communication with the inlet for producing a water stream with a flow rate;

a shaft assembly rotatably supported by the housing and including a distribution outlet for directing and discharging the Water stream from the sprinkler in a first distribution direction;

a drive assembly for rotating the shaft assembly in response to receiving a portion of the water stream for a period of time to reposition the distribution outlet to discharge water from the distribution outlet in a second distribution direction, the drive assembly including an impact arm having an outer surface and a water-receiving surface defining an arm inlet, an arm outlet, a passageway between the arm inlet and arm outlet, and a discharge portion for discharging water from the arm outlet, wherein the water stream from the distribution outlet is discharged directly to the environment prior to and subsequent to the period of time, and the stream water from the distribution outlet is received by the impact arm at the arm inlet during the period of time, the water received by the impact arm is discharged in a stream by the discharge portion from the arm outlet, the rotational force on the discharge portion forces the drive assembly to rotatably shift away from water stream from the distribution outlet at the conclusion of the period of time, and the outer surface and an inlet portion of the water-receiving surface are joined in a direction through which water from the distribution outlet may be directed at the beginning of and the end of the period of time.

19. The rotary sprinkler of claim 18 wherein the inlet portion of the water-receiving surface and the outer surface are joined to form a smooth and small radius surface.

20. The rotary sprinkler of claim 18 wherein the inlet portion of the water-receiving surface and the outer surface are joined to form a point.

21. The rotary sprinkler of claim 18 wherein the inlet portion of the water-receiving surface is configured to receive water thereagainst from the distribution outlet, and the outer surface is configured so that water from the distribution outlet does not strike thereon.

* * * * *

UNITED STATES PATENT AND TRADEMARK OFFICE

CERTIFICATE OF CORRECTION

PATENT NO. : 7,216,817 B2
APPLICATION NO. : 11/182434
DATED : May 15, 2007
INVENTOR(S) : Michael F. Turk et al.

It is certified that error appears in the above-identified patent and that said Letters Patent is hereby corrected as shown below:

IN THE CLAIMS:

Column 22, line 30, delete “art” and insert --an-- therefor.
Column 22, line 42, delete “sprindler” and insert --sprinkler-- therefor.
Column 24, line 13, delete “Water” and insert --water-- therefor.

Signed and Sealed this

Eighteenth Day of December, 2007

JON W. DUDAS
*Director of the United States Patent and Trademark Office*